US007861444B2

(12) United States Patent
Marlow

(10) Patent No.: US 7,861,444 B2
(45) Date of Patent: Jan. 4, 2011

(54) ANIMATED ARTIFICIAL FLOWER

(76) Inventor: Peter Marlow, 12250 Woodley Ave., Granada Hills, CA (US) 91344

( * ) Notice: Subject to any disclaimer, the term of this patent is extended or adjusted under 35 U.S.C. 154(b) by 143 days.

(21) Appl. No.: 12/140,160

(22) Filed: Jun. 16, 2008

(65) Prior Publication Data

US 2008/0311316 A1 Dec. 18, 2008

Related U.S. Application Data

(60) Provisional application No. 60/936,158, filed on Jun. 16, 2007.

(51) Int. Cl.
*G09F 19/08* (2006.01)

(52) U.S. Cl. ..... 40/411; 40/412; 40/427; 472/54; 446/308

(58) Field of Classification Search ..... 40/411; 472/137, 51, 54, 55, 65; 446/308
See application file for complete search history.

(56) References Cited

U.S. PATENT DOCUMENTS

| | | | | | |
|---|---|---|---|---|---|
| 530,870 | A | | 12/1894 | Wenger | |
| 1,916,988 | A | * | 7/1933 | Pieschke | 40/412 |
| 3,460,426 | A | | 8/1969 | Jensen | |
| 3,471,964 | A | | 10/1969 | Cherry et al. | |
| 3,811,990 | A | * | 5/1974 | Stoff | 40/411 |
| 4,552,339 | A | | 11/1985 | Werners et al. | |
| 4,910,647 | A | | 3/1990 | Gong | |
| 4,983,890 | A | | 1/1991 | Satoh et al. | |
| 5,056,249 | A | | 10/1991 | Sakurai | |
| 5,144,880 | A | * | 9/1992 | Schmit | 99/342 |
| 5,147,265 | A | | 9/1992 | Pauls et al. | |
| 5,389,030 | A | * | 2/1995 | Chapkis | 446/397 |
| 5,522,758 | A | * | 6/1996 | Liu et al. | 446/310 |
| 5,713,664 | A | * | 2/1998 | Harilela | 366/129 |
| 5,776,561 | A | | 7/1998 | Lindauer | |
| 5,946,835 | A | * | 9/1999 | Boyd | 40/412 |
| 5,947,582 | A | | 9/1999 | Huang | |
| 6,001,019 | A | * | 12/1999 | Al-Bannai | 472/54 |
| 6,036,559 | A | | 3/2000 | Arnold et al. | |

(Continued)

OTHER PUBLICATIONS

International Search Report and Written Opinion for PCT/US06/61051 dated Jul. 18, 2008.

(Continued)

*Primary Examiner*—Lesley Morris
*Assistant Examiner*—Christopher E Veraa
(74) *Attorney, Agent, or Firm*—Knobbe Martens Olson & Bear, LLP

(57) ABSTRACT

A device which simulates natural flowering actions, including growth and efflorescence, is actuated by partial immersion of a stem into a liquid. An aperture through the stem base admits the liquid into the stem. A piston slidably disposed within the stem is driven downwardly by the bias force of a resilient spring while an agent which impedes the piston motion dissolves in the liquid. Growth is simulated by a sleeve outside the stem which descends in relation thereto to push the flower upwardly. A simulated corolla is attached to the stem and gradually rotates and opens during the ascent thereof. A cam controls the pivotal position of lifters which open and close the corolla. The petals of the corolla vibrate before opening and open with variations in starting time. As the corolla opens, a surprise gift, gradually ascending on a presentation platform, is revealed. The device may be reused.

21 Claims, 24 Drawing Sheets

U.S. PATENT DOCUMENTS

| | | | | |
|---|---|---|---|---|
| 6,389,718 | B1 | 5/2002 | Joo | |
| 6,726,572 | B1 * | 4/2004 | Versen | 472/54 |
| 2004/0111935 | A1 * | 6/2004 | Tipay | 40/414 |
| 2005/0084413 | A1 | 4/2005 | Stanley, III | |
| 2006/0254098 | A1 * | 11/2006 | Fu | 40/411 |

OTHER PUBLICATIONS

International Search Report and Written Opinion for PCT/US08/66997 dated Sep. 4, 2008.
International Search Report and Written Opinion for PCT/US08/67155 dated Sep. 2, 2008.
U.S. Appl. No. 12/139,193, filed Jun. 13, 2008, Marlow, Peter.
U.S. Appl. No. 11/561,208, filed Nov. 17, 2006, Marlow, Peter.
International Preliminary Report on Patentability and Written Opinion mailed on Dec. 17, 2009 in PCT Application No. PCT/US2008/066997.
International Preliminary Report on Patentability and Written Opinion mailed on Dec. 17, 2009 in PCT Application No. PCT/US2008/067155.
Non-final Office Action mailed on Jan. 8, 2010 in U.S. Appl. No. 11/561,208.
Allowed claims in U.S. Appl. No. 11/561,208, allowed on Jul. 26, 2010.

* cited by examiner

ANIMATED ARTIFICIAL FLOWER

CROSS-REFERENCE TO RELATED APPLICATIONS

This application claims the benefit of U.S. Provisional Patent Application No. 60/936,158, filed Jun. 16, 2007, the entire disclosure of which is hereby incorporated by reference herein and should be considered a part of this specification.

BACKGROUND OF THE INVENTION

1. Field of the Invention

The present invention relates generally to artificial flowers, and more specifically to an animated artificial flower device which, upon partial immersion in a liquid, simulates natural flowering actions and reveals a surprise object.

2. Description of the Related Art

Artificial flowers are commonly used as indoor decorative accessories. Natural flowers, whether planted, potted, or cut for use in a vase, also have wide appeal as an enhancement to all sorts of environments. Natural flowers share many of the advantages of artificial flowers, and, if cared for appropriately, are capable of growing and blooming in a pleasing way. Many thousands of people enjoy receiving flowers in one form or another on a daily basis throughout the world.

SUMMARY OF THE INVENTION

In view of the circumstances noted above, an aspect of at least one of the embodiments disclosed herein is to provide an animated artificial flower device that has the appearance of a long-stem cut flower and that can simulate growth and blooming when placed in water or other liquid. In some embodiments, the artificial flower can provide a gradual or controlled presentation of a blooming flower and can be reusable. Moreover, in some embodiments, the artificial flower device can enable the presentation of a gift or surprise concealed within the closed flower.

In accordance with one embodiment, an animated artificial flower device is provided. The device comprises a stem, a sleeve movably coupled to the stem, and a piston movably disposed within a piston chamber in the stem and operatively coupled to the sleeve, the piston biased downwardly, said piston chamber configured to receive an impeding agent therein. A plurality of simulated petals define a corolla, the petals moveable between a closed state and an opened state, the petals operatively coupled to the piston. The piston is configured to move downwardly relative to the stem upon exposure of the impending agent to a liquid that diminishes the effective size of the impeding agent, the movement of the piston actuating the movement of the petals toward the opened state, said downward movement of the piston actuating a downward movement of the sleeve relative to the stem to thereby simulate flower growth.

In accordance with another embodiment, an animated artificial flower device is provided. The device comprises a stem having a base, a sleeve movably coupled to the stem, and a plurality of simulated petals defining a corolla, the petals moveable between a closed state and an opened state, the petals operatively coupled to the sleeve. The device also comprises means for transmitting a force between the stem and the plurality of petals to move the petals into the opened or closed state, said means actuatable via exposure of at least a portion of the stem to a liquid so that the liquid enters the stem via apertures in the stem base, wherein said exposure of the stem to the liquid actuates a downward movement of the sleeve relative to the stem to thereby simulate flower growth.

In accordance with another embodiment, a method for operating an animated artificial flower having a stem and a plurality of simulated petals operably coupled to the stem, the petals configured to overlap with each other and movable between a closed state and an opened state is provided. The method comprises exposing an impeding agent in the stem to a liquid, the impeding agent being adjacent a piston movably disposed within the stem of the artificial flower so as to change the effective size of the impeding agent to thereby gradually move the piston downwardly relative to the stem, and actuating a presentation platform operatively coupled to the stem to move upwardly relative to the stem as the piston moves downwardly.

BRIEF DESCRIPTION OF THE DRAWINGS

These and other features, aspects and advantages of the present invention will now be described in connection with a preferred embodiment of the invention, in reference to the accompanying drawings. The illustrated embodiment, however, is merely an example and is not intended to limit the invention. The drawings include the following 24 figures, in which like numerals indicate like parts.

DETAILED DESCRIPTION OF THE PREFERRED EMBODIMENTS

Introduction

Figure 1:
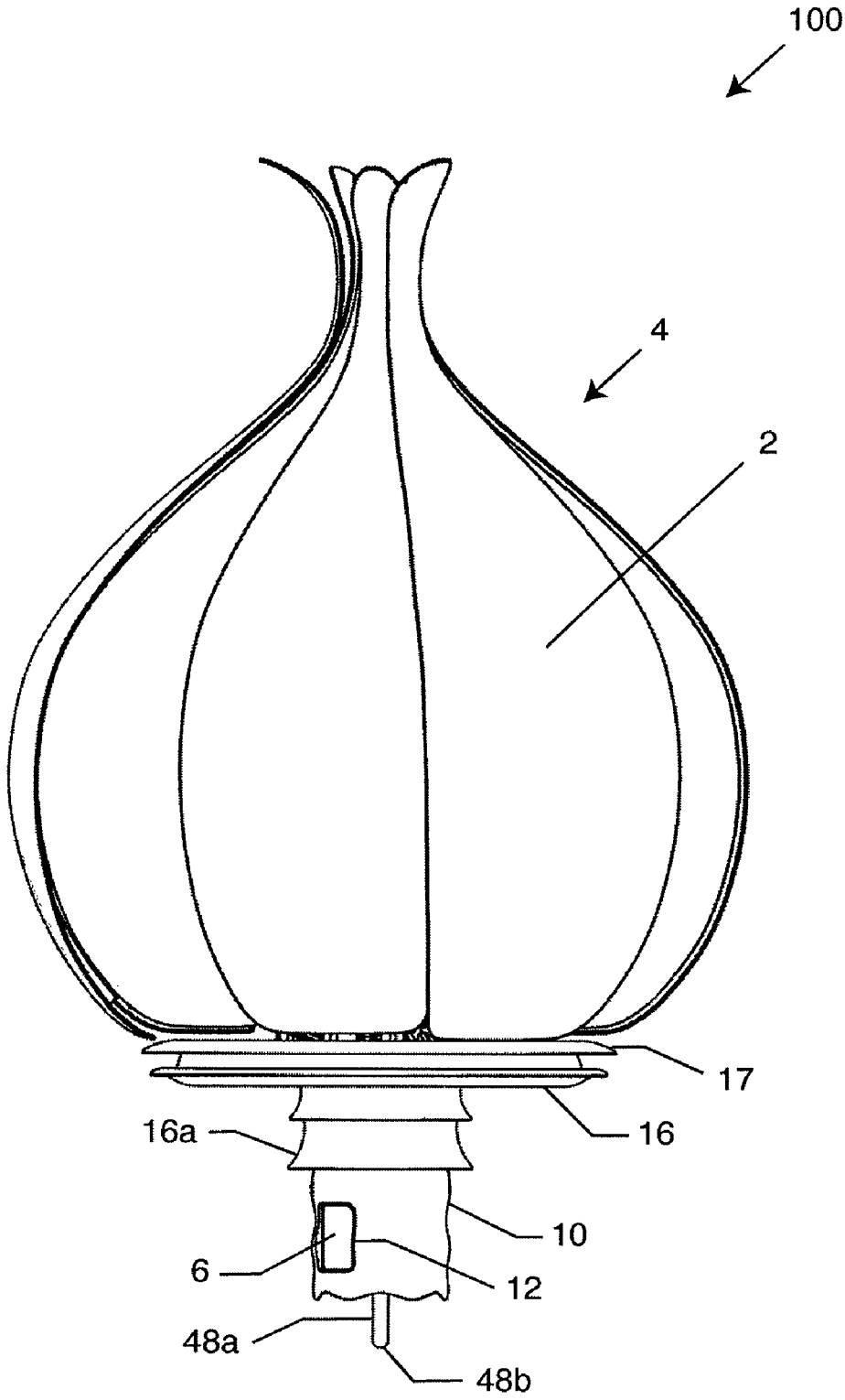
FIG. 1 is a front view of one embodiment of an animated artificial flower device, with the petals in a closed state.

Artificial flowers, though available in a large assortment of types and forms, are almost universally static. The ubiquity of static artificial flowers, despite some being quite attractive, has made them familiar fixtures upon which little attention is focused. They can beautify a setting or evoke feelings of tranquility, but they do not deliver a dynamic or captivating interactive experience. Certainly, an observer has no expectation of animation therefrom in the form of realistic growth or blooming.

As noted above, natural flowers have certain advantages with respect to artificial flowers. For example, if cared for appropriately, natural flowers are capable of growing and blooming in a pleasing way. However, because such vitality progresses very slowly, it is difficult to observe. Furthermore, the beauty of natural flowers quickly fades. Because they are so commonplace, natural flowers, like static artificial flowers, are generally not objects of sustained or exceptional interest.

Even though many people enjoy receiving flowers, their delight typically peaks at the initial presentation and quickly passes. The flowers are soon forgotten. There is no expectation of later discovery of additional excitement originating therewith.

There exists a continuing human need for objects that delight and enchant by their ability to transcend expectations. An artificial flower that gradually grows, blooms and delicately reveals a surprise gift from within its corolla satisfies such a need, and more so if the recipient is invited to participate by providing the type of care and handling normally given a natural flower. The experience can be further enhanced if the actions of the flower are rendered by a mechanism that is not readily apparent or easily understood.

There exist conventional artificial flowers that simulate blooming, present a surprise gift, or use water as an actuating component. These are typically driven by relatively large machinery appending the stem, usually concealed in a flower pot or other base. In addition to the inconvenience posed by the size and weight of many of these bases, the users of such artificial flowers cannot enjoy the degree of mystery and wonder that can entertain users of an animated artificial flower having no base machinery. Indeed, some bases simply cannot hide their mode of operation, such as when the application of manual or electric force is required. Manual actuation of animation in an artificial flower device, even in the absence of a large base is generally undesirable where a realistic or more intriguing experience by the recipient is intended.

A large attached base also precludes the distinct advantage of being able to present the device as a long-stemmed cut flower. The care and handling of an animated artificial flower in a manner not unlike that given a natural flower involves a recipient in a rewarding adventure that adds to the satisfaction of the experience. Particularly, actuation of the animation activities of the artificial flower by nothing more than the placement of its stem in a container of water is advantageous. Certain conventional animated artificial flowers are incapable of providing this experience because water must be applied into or through the exposed center of its corolla, whereupon it quickly opens. For this reason, it is also impractical for such devices to conceal a surprise gift.

The slow and gradual ascent of a surprise gift from within an opening corolla is a feature that transforms an animated artificial flower from a pleasant toy to a more refined and stylish instrument capable of making an elegant presentation. Reusability in such a device adds still more to its value. It further defies expectations and excites the imagination that such a device could be prepared for reuse by refilling a small chamber within the stem with a common ingredient, such as granulated sugar.

Accordingly, disclosed herein are various embodiments of animated artificial flower devices that can faithfully recreate the general appearance of a long-stemmed cut flower and that simulate gradual growth and blooming when exposed to a liquid, such as water. In certain embodiments, the flower can additionally, alternatively or optionally lift a surprise object from within its corolla. In certain embodiments, the flower is advantageously reusable. Certain embodiments provide these features in addition to other unique and novel features.

Terminology

By being labeled with terms commonly understood to identify parts of a natural flower, some of the component parts of the embodiments are suggested to resemble, but are not limited to, some of the visual aspects and mechanical attributes of such parts of a natural flower. For example, except when modified by the word "natural", the term "petal" identifies a component part of the embodiments which can resemble a natural petal. Furthermore, except when modified by the word "natural", the term "flower" identifies one or more of the several example embodiments disclosed herein. Continuing the example, the terms "natural petal" or "natural growing flower" identify matter having a biological origin.

The words "open" and "closed," when used in connection with the words "petal" and "corolla" in phrases such as "closing the petals," "an opening force to the petals," "to open the corolla" and "closed-corolla," indicate a state of or phase in the development of animation in the petals or corolla. The word "open" indicates the petals or corolla in a state generally resembling a mature natural flower at the peak of anthesis, the petals projected outwardly at or toward their maximum extension. The word "closed" indicates the petals or corolla in a state generally resembling a maturing natural flower immediately prior to the start of anthesis, the petals drawn together inwardly at or toward their minimum extension. The terminology includes the words specifically mentioned above and their derivatives.

The words "open" and "closed," when used herein throughout the specification and appended claims in connection with the word "flower" in phrases such as "the flower in a closed state," "to open the flower," "the flower is thereby closed" and "the opened flower," indicate a starting (e.g., "closed") or ending (e.g., "open") state in the development of animation in the flower and is not limiting. The terminology includes the words specifically mentioned above and their derivatives.

Many of the component parts of the embodiments described herein are shown in a simplified form to facilitate understanding. During the process of manufacturing and assembling these embodiments, the use of adhesive materials and methods individually or in combination, such as glues, epoxies, solvent based adhesives, rivets, nuts, bolts, snap fits, press fits, locking features, screw threads, ultrasonic welding, and the like, to join multiple subunits of a component part shown or described as a single, integrally formed unit, can be used. Conversely, adjoining component parts, each shown or described as separate or independent units, can optionally be manufactured and assembled as one single, integrally formed unit.

Unless otherwise specified, certain terminology is used to indicate an adherence, link or association between two or more component parts for convenience only and is not limiting. The words "connect," "attach," "bond," "fasten," "join," "affix" and "secure," their derivatives and words of similar meaning designate adherence, whether durable, transitory, fixed or movable, or otherwise. This could be accomplished using a variety of different techniques, such as the use of: an adhesive material or method (some examples of which are listed in the preceding paragraph); and/or a mechanical link between two or more discrete component parts with or without the intermediate use of additional component parts, whether referenced or not; and/or an intrinsic association between two or more sections of a single, integrally formed component part that is one unit; and/or a combination of the above.

Component parts described and/or labeled as a "cable" or a "line" are typically a type of flexible thread or cord, but can also be a rigid rod or shaft, or can comprise other properties. The cable or line can comprise, but is not limited to, materials such as stainless steel, steel, brass, silk, nylon, polyester, polyethylene, polypropylene, polyvinyl chloride, acrylonitrile butadiene styrene, and the like. The cable or line can be monofilament or multifilament, rigid or flexible, elastic or unyielding, coarse or fine, plated, unplated, coated, uncoated, uniform, a combination or composite of various materials, and the like.

The words "right," "left," "front," "rear," "lower" and "upper" designate directions in the drawings to which the reference is made, or in the referenced embodiments when positioned as suggested by the drawings and descriptions thereof. The words "vertical" and "horizontal" designate, respectively, a general alignment to the upper/lower direction and a general perpendicularity thereto. The words "inwardly" and "outwardly" designate all directions toward and away from, respectively, the geometric center of the applicable parts or embodiments, and unless otherwise noted, apply to a generally horizontal plane. The terminology includes the words specifically mentioned above, their derivatives and words of similar meaning.

Unless otherwise noted, the meanings of words which designate or describe geometric figures, shapes and structures, such as, "round," "tube," "circle," "square," "rectangle," "ellipse," "cylinder," "sphere," "cube," "torus," "globe," "encircle," "diameter," "cone," "radius" and "circumference," include their literal meaning, as well as figures, shapes and structures that can be imperfect, irregular, asymmetric or embellished. The terminology includes words which designate or describe geometric figures, shapes and structures, their derivatives and words of similar meaning.

References are made herein to an "impeding agent". An impeding agent is a substantially solid or rigid material which can occupy a volume to block or impede motion of a member within the volume, and, by an exposure to a select liquid, dissolve, chemically react, effervesce, disintegrate, soften, collapse, break down, or otherwise change from the solid state or rigid structure thereof to a state or structure which allows the motion of the member within the volume. One function of an impeding agent is to block animation of a mechanism prior to an exposure of the impeding agent to the select liquid, whereupon, following an exposure of the impeding agent to the select liquid, as the impeding agent gradually loses its solid state or rigid structure, the action of the mechanism proceeds at a rate commensurate to a reduction in the effective size, either by solid volume or rigid shape, of the impeding agent.

The impeding agent can be a single one-piece unit or a measure of a loose material in a fine particulate, medium granular or coarse pellet form. The impeding agent can also be a combination of a one-piece unit and a measure of material, and can also comprise other forms. The one-piece unit can be homogenous, hollow, a rigid foam, a porous aggregate of dissimilar particles held together by a soluble binder, or can comprise other physical structure or structures. The impeding agent can comprise varying materials and/or densities to provide non-linear performance. The impeding agent can fully fill the volume or narrowly occupy the volume by only contacting the moving member at one end and an opposing wall of the volume at another end. The impeding agent can comprise forms such as a rolled tube, extruded rod, molded plug, beads, tablets, powder, grains, and the like. The impeding agent can comprise sugar, as it is readily available, safe, and dissolves at a reasonable rate. Of course, the impeding agent can comprise other ingredients, alone or in combination, such as soap, table salt, soluble paper, paper, soluble plastics (such as polyvinyl alcohol and polyvinylpyrolidone), gelatin, candy, flavored drink mix, and the like. For example, certain embodiments are usable to disperse a flavored drink mix into a pitcher of water for human consumption.

The impeding agent can comprise combinations of substances which chemically react when exposed to a select liquid. For example, a dry mixture of an acid and base, such as citric acid and sodium bicarbonate, when exposed to water, can effervesce, forming gas and other byproducts. A disintegrant, such as starch, cellulose, cross-linked polyvinyl pyrrolidone, sodium starch glycolate, and sodium carboxymethyl cellulosemethycellulose, can be employed to accelerate dissolution. A paper tube can be so formed and placed within the volume as to gradually soften and collapse, partially disintegrate or fully dissolve upon exposure to a select liquid. Insoluble remains and byproducts can be readily accommodated with small modifications in the design and method presented herein, for example, by providing an additional space therefor within the volume and by providing for the manual removal of the insoluble remains and byproducts from the volume after use.

The impeding agent can comprise two or more layers, the layers differing by properties such as material composition, material density, physical structure and structural rigidity. One layer can be partially or fully coated by, glazed by, packaged within or otherwise enclosed by another layer. Each layer can respond differently to an exposure by a select liquid. One layer can dissolve, chemically react, effervesce, disintegrate, soften, collapse, break down, or otherwise change from its solid state or rigid structure more quickly or readily than another layer. For example, a paper or soluble plastic tube can be a container for other soluble substances in a granular form, providing a convenient packaging and a way to delay the start of actuation. The combination impeding agent comprising the tube enclosure and soluble granules enclosed therein can be inserted into the volume as one unit. The tube enclosure can fully impede the development of motion within the volume for a set time during exposure to a select liquid until the tube dissolves, disintegrates or softens, collapses and/or breaks down, whereupon the motion of the member within the volume proceeds and is regulated by the dissolution of the granular contents previously enclosed within the tube.

The collapse of such an enclosure and the release of the contents thereof, the enclosure having a substantially smaller diameter than the volume, can provide a relatively rapid step function in the initial motion of the member within the volume. In addition to paper or plastic, soluble coatings or glazings comprising types of substances such as sugars, starches, proteins, fibers, gums, and varnishes, alone or in combination, can also be used to form an outer layer. The rigid structure of the impeding agent is maintained during the initial softening, disintegration or dissolution of the enclosing material during exposure to a select liquid, allowing little or no progress in the motion of the member within the volume. Upon the collapse, substantial disintegration or dissolution of the enclosing material, the rigid structure is lost and the motion of the member within the volume progresses while the previously enclosed material dissolves. Actuation of animation in the artificial flower can follow an exposure to a select liquid by a delay time set by design.

The meaning of the term "dissolve" shall be expanded to include chemically react, effervesce, disintegrate, soften, collapse, break down, or otherwise change from a solid state or rigid structure to a state or structure ineffective at providing a blocking or impeding function, and shall be understood in accordance with the specific impeding agent being contemplated. The derivatives of the term "dissolve," including "solution," "dissolution" and "dissolvable," shall receive a comparably expanded understanding.

The term "select liquid" refers to a liquid in which the impeding agent being contemplated is soluble, or capable of chemically reacting, effervescing, disintegrating, softening, collapsing, breaking down, or otherwise being changed from a solid state or a rigid structure to a state or structure ineffective at providing a blocking or impeding function. The select liquid can comprise water or a solution thereof. The select liquid can also comprise non-aqueous liquids, such as oils or alcohols.

References are made herein to a "surprise object" or "surprise gift". The terms are used interchangeably. The surprise object or surprise gift is an article having tangible substance that can be provided by the flower or manually associated to the flower by a user for any intent or purpose. The surprise object or surprise gift can be removable or can be durably attached to the flower, can comprise a mounting adapter, removable covering, openable container or other enclosure or housing, and is not limited and does not exclude any article or number of articles or combination of articles. For example, the surprise object or surprise gift can comprise a doll, figurine, animated fairy, toy animal, pieces of chocolate or candy, photograph, written message, invitation, airline tickets, coupon, container of perfume, air freshener gel, car key, watch, engagement ring, pair of earrings, and the like. In certain embodiments, the surprise object or surprise gift, mounting adapter and/or enclosure independently or interconnectedly can comprise an electric battery, switch, and/or electronic circuit and/or mechanical apparatus, to provide features such as illumination, sound generation, moving parts, release of a fragrant substance, and the like.

Detailed Description of Selected Example Embodiments

As shown in the accompanying drawings, certain embodiments provide animation and the presentation of a surprise gift in an artificial flower device. In one embodiment, the device closely resembles a long-stemmed cut flower. A spring and piston driven mechanism actuated by placement of the stem into a select liquid is used to simulate natural flowering and/or other actions. Further information on artificial flower devices can be found in U.S. patent application Ser. No. 12/139,193, filed Jun. 13, 2008 and titled Animated Artificial Flower, and U.S. Provisional Patent Application No. 60/934,405, filed Jun. 13, 2007, the entire contents of both of which are hereby incorporated by reference and should be considered a part of this specification.

Figure 2:
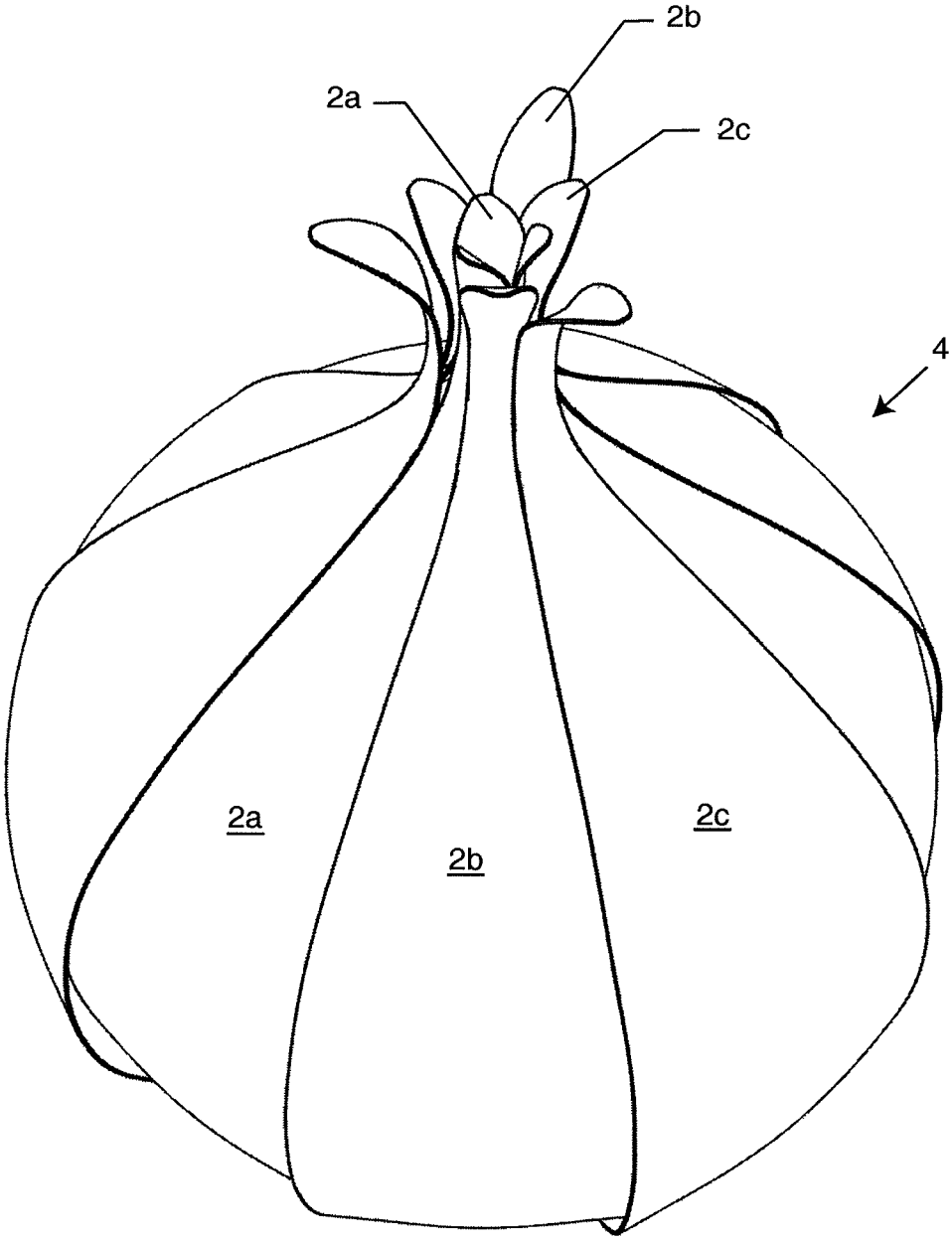
FIG. 2 is a perspective top view of the artificial flower of FIG. 1.
Figure 3:
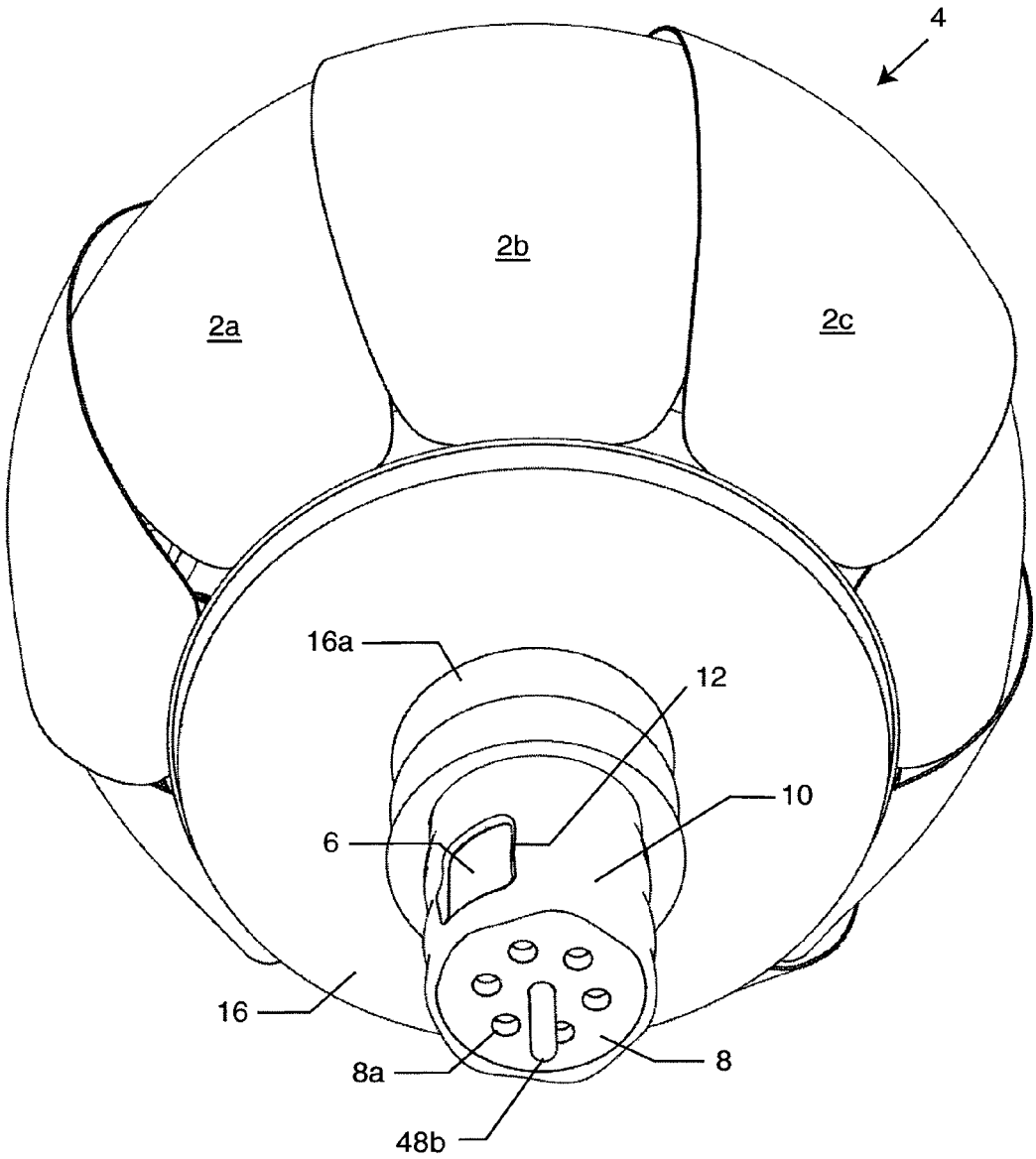
FIG. 3 is a perspective bottom view of the artificial flower of FIG. 1.

FIGS. 1-24 illustrate one embodiment of an animated artificial flower 100. The artificial flower 100 preferably includes a plurality of simulated petals 2 that define a corolla 4. In one embodiment, at least one of the petals 2 overlaps a second petal 2, as shown in FIG. 2. The artificial flower 100 can also have a stem 6 with a stem base 8. A sleeve 10 can be movably disposed (e.g., slidable) over the stem 6 and have an opening 12 defined therein. With continued reference to FIGS. 1-7, the artificial flower 100 can have an upper cover 14 operatively coupled to the stem 6, the upper cover 14 having a top portion 14*a* and an opposite bottom portion 14*b*. A lower cover 16 can be removably coupled to the upper cover 14, and a cover filler 17 disposed between the upper and lower covers 14, 16.

Figure 4:
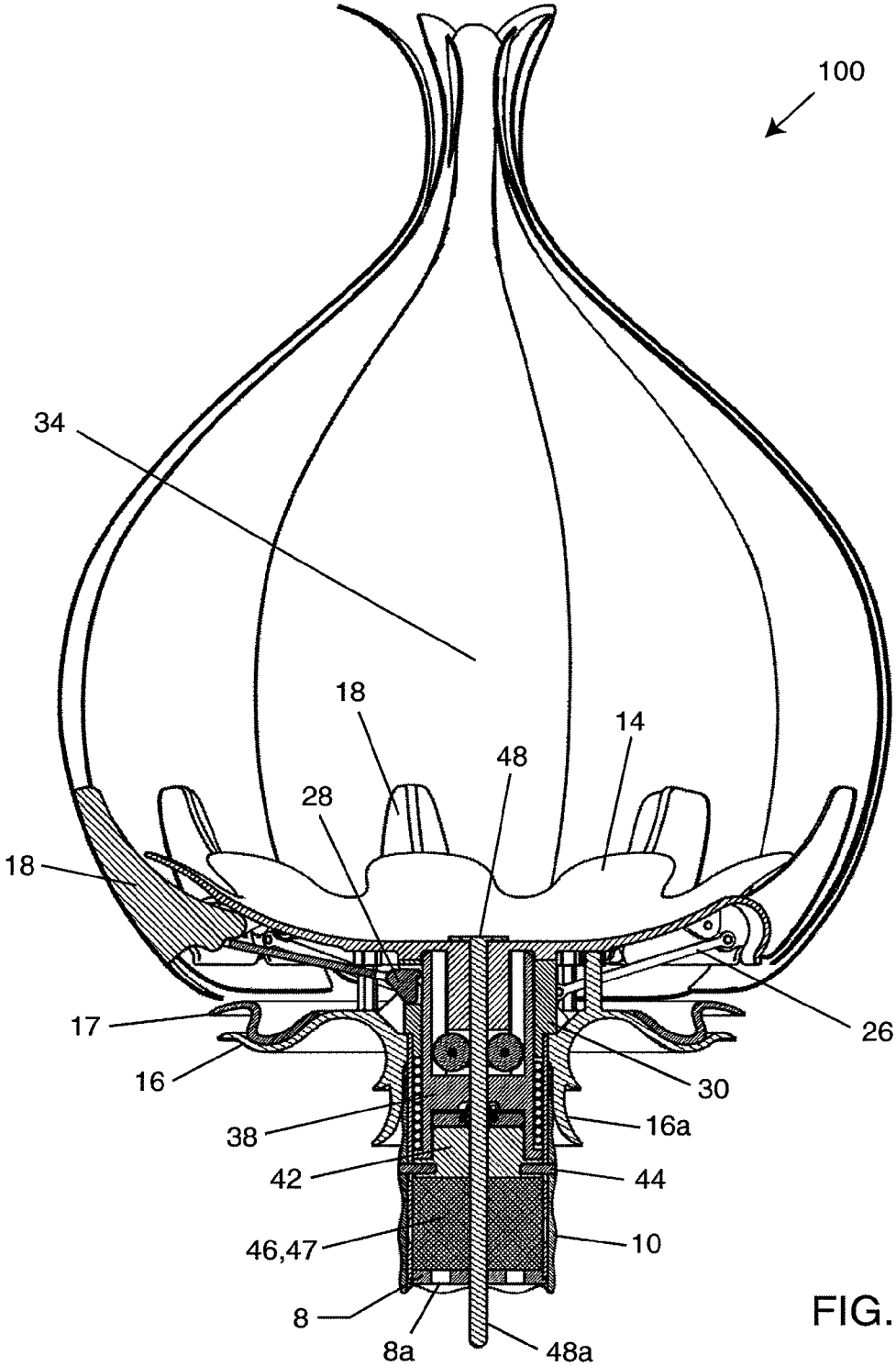
FIG. 4 is a cross-sectional side view of the artificial flower of FIG. 1.
Figure 5:
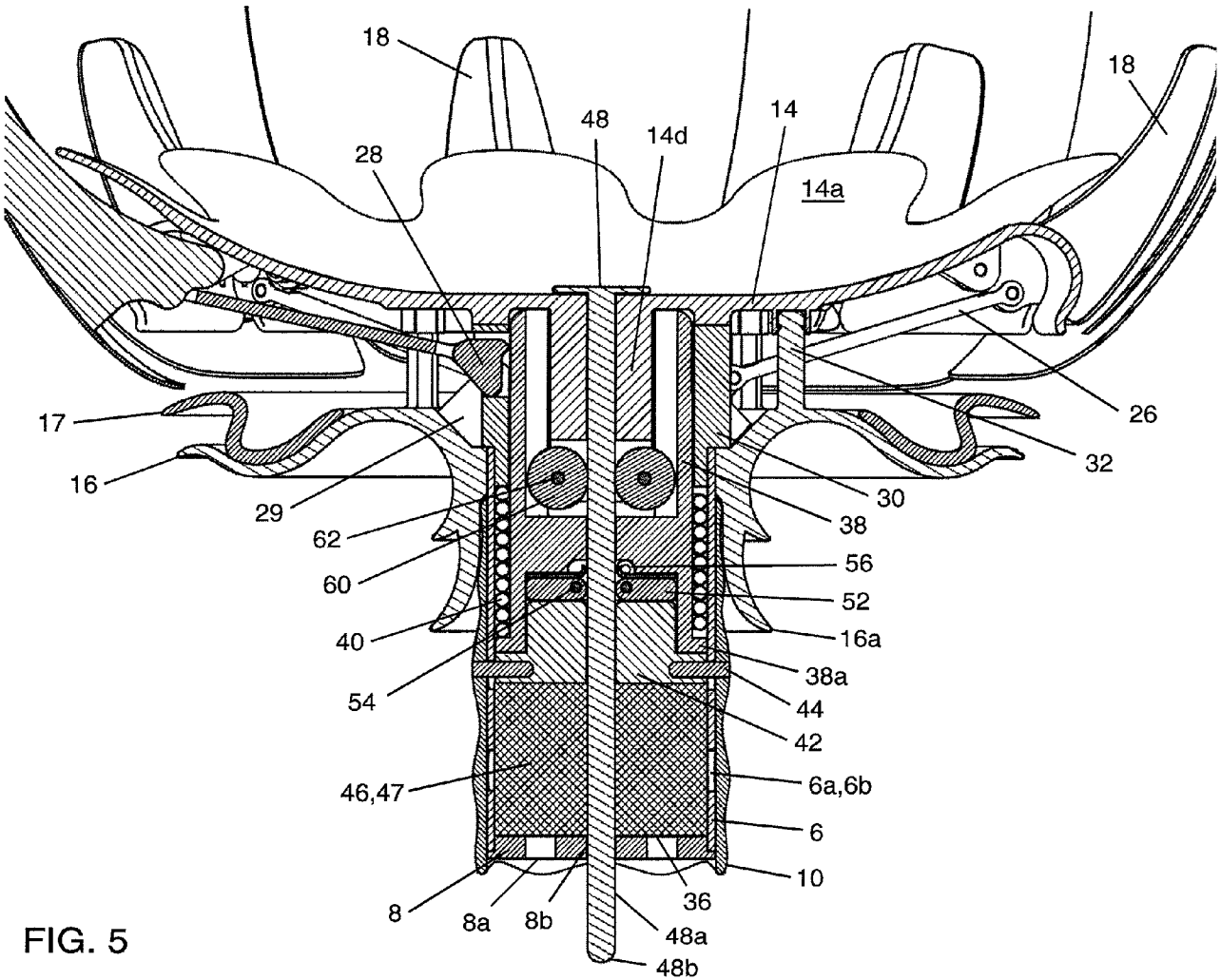
FIG. 5 is an enlarged partial cross-sectional side view of the artificial flower of FIG. 4.
Figure 8:
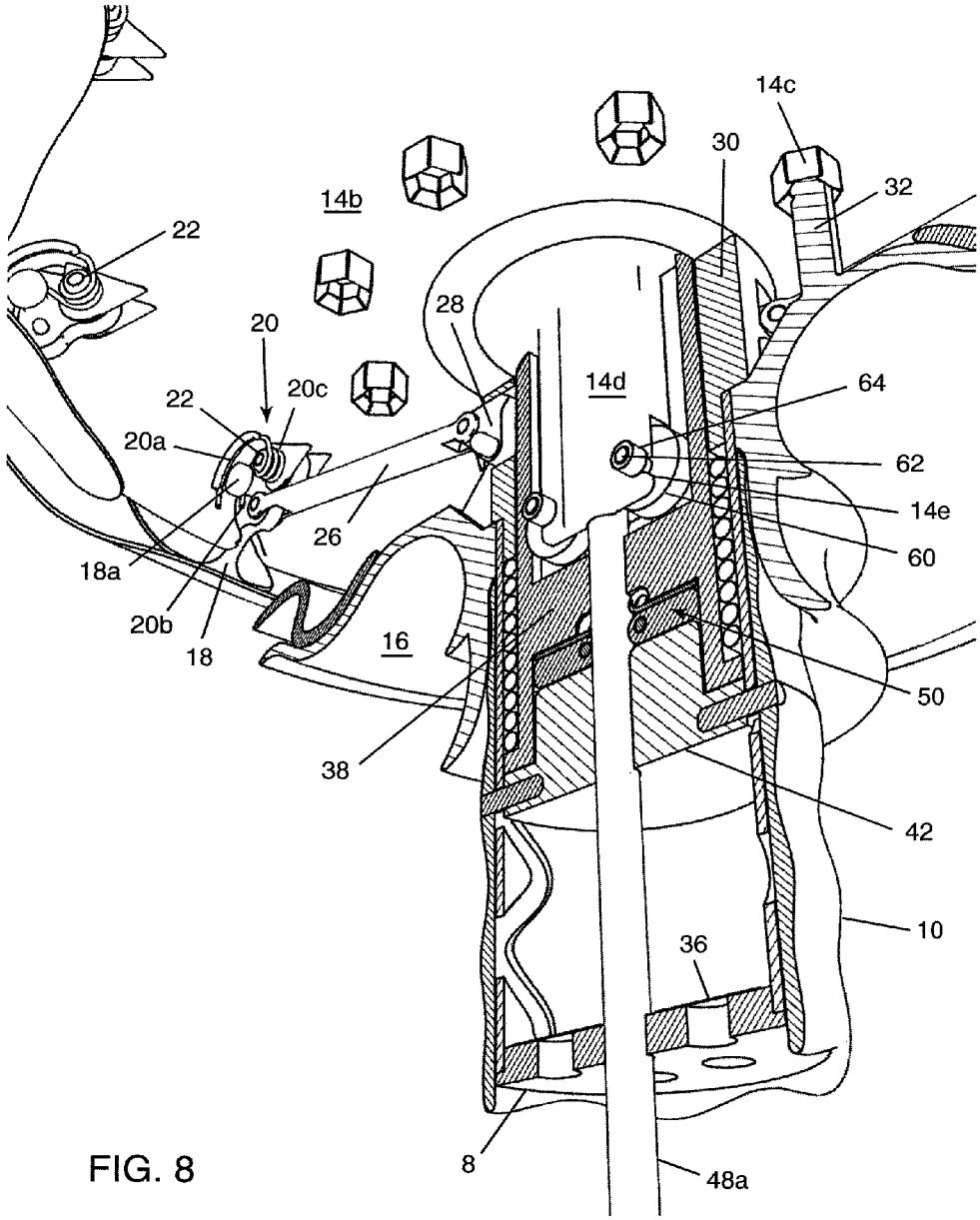
FIG. 8 is an enlarged partial cross-sectional perspective bottom view of the artificial flower of FIG. 1.
Figure 9:
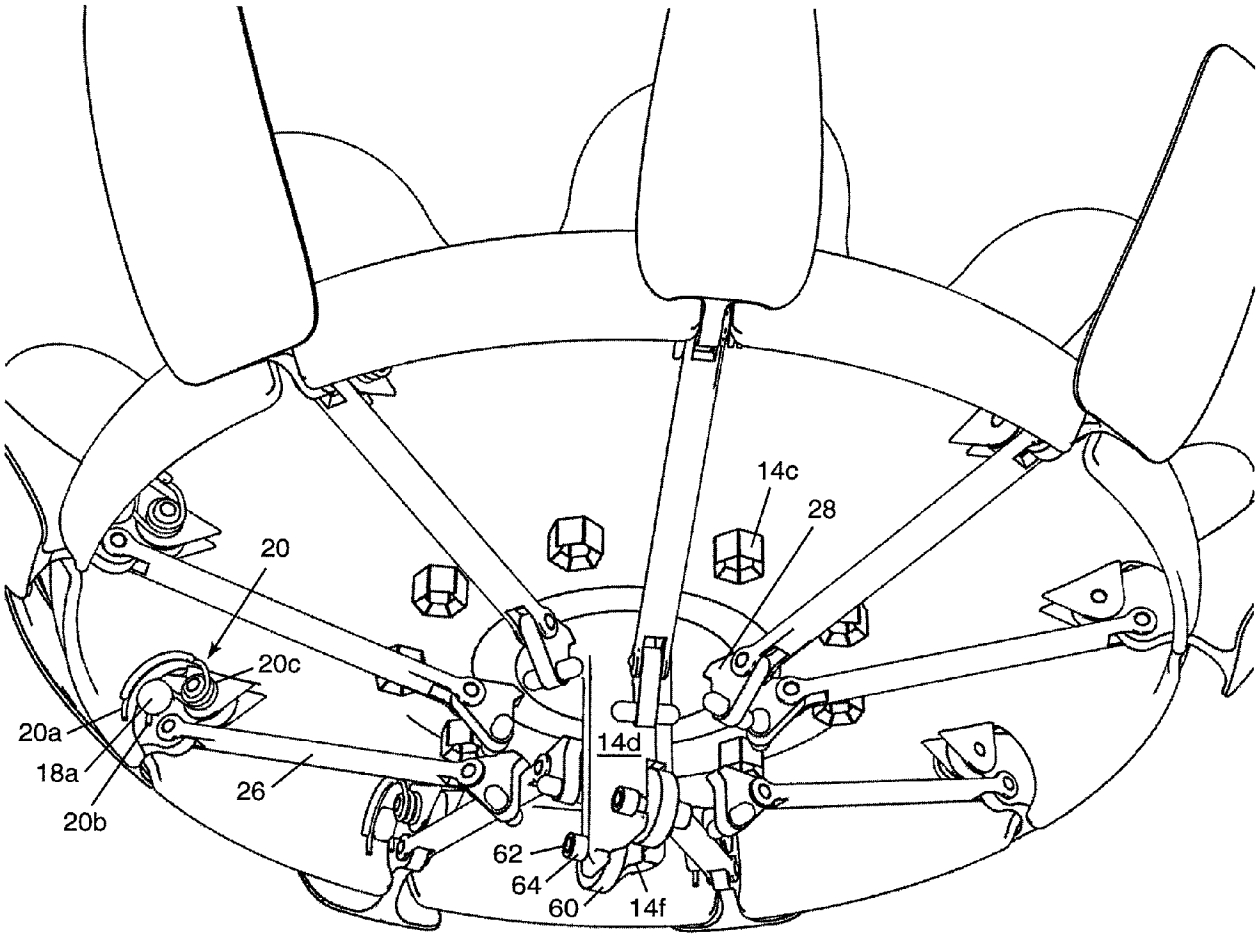
FIG. 9 is a partial perspective bottom view of the upper cover of the artificial flower of FIG. 4.

With continued reference to FIGS. 4-5, each of the petals 2 can be attached to a petal shoe 18. Each petal shoe 18 can be pivotally attached to the upper cover 14. A petal spring 20 (see FIG. 8) can be coupled to each petal shoe 18. The petal spring 20 can be a resilient angular torsion spring with a helically wound portion 20*c* disposed over a cylindrical pin portion 22 on the bottom portion 14*b* of the upper cover 14 (see FIG. 8). As shown in FIGS. 8-9, the petal spring 20 can also have a first extension 20*a* disposed adjacent the bottom portion 14*b* of the upper cover 14 and a second extension 20*b* in contact with a post 18*a* of the petal shoe 18 so that the petal spring 20 is held in a compressed state between the petal shoe 18 and the bottom portion 14*b* of the upper cover 14.

As shown in FIG. 8, a rod 26 can be pivotally coupled to a petal shoe 18 at one end and pivotally coupled to a lifter 28 at an opposite end, and disposed between the upper and lower covers 14, 16. The lifter 28 can be pivotally attached to a cylindrical lifter frame 30 (see FIG. 8, 10) and held in place by a key 29 (see FIGS. 5-7) projected upwardly from the lower cover 16 and fitted into a matching guide 30*c* (see FIG. 10) of the lifter frame 30. The lifter frame 30 can extend between an upper end 30*a* and a lower end 30*b* thereof, secured between the upper and lower covers 14, 16. The upper and lower covers 14, 16 can be securely connected by at least one post 32 (see FIG. 5-8) projecting upwardly from the lower cover 16. In one embodiment, a male head portion 32*a* (see FIG. 6-7) of the post 32 can be snap-fit into a female socket 14*c* (see FIG. 6) formed in the bottom portion 14*b* of the upper cover 14.

Figure 10:
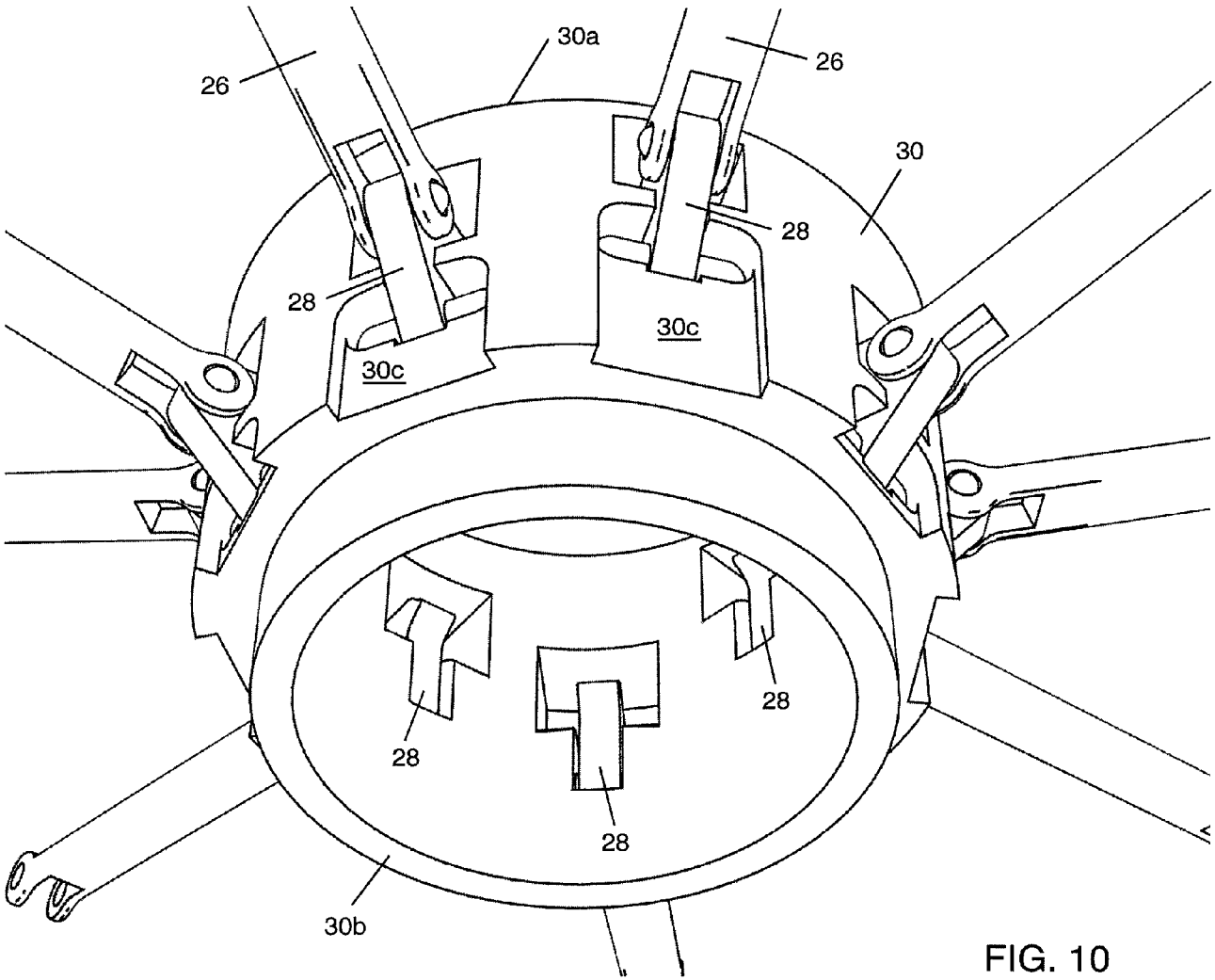
FIG. 10 is a perspective bottom view of components of the petal deploying mechanism of the artificial flower of FIG. 4.
Figure 11:
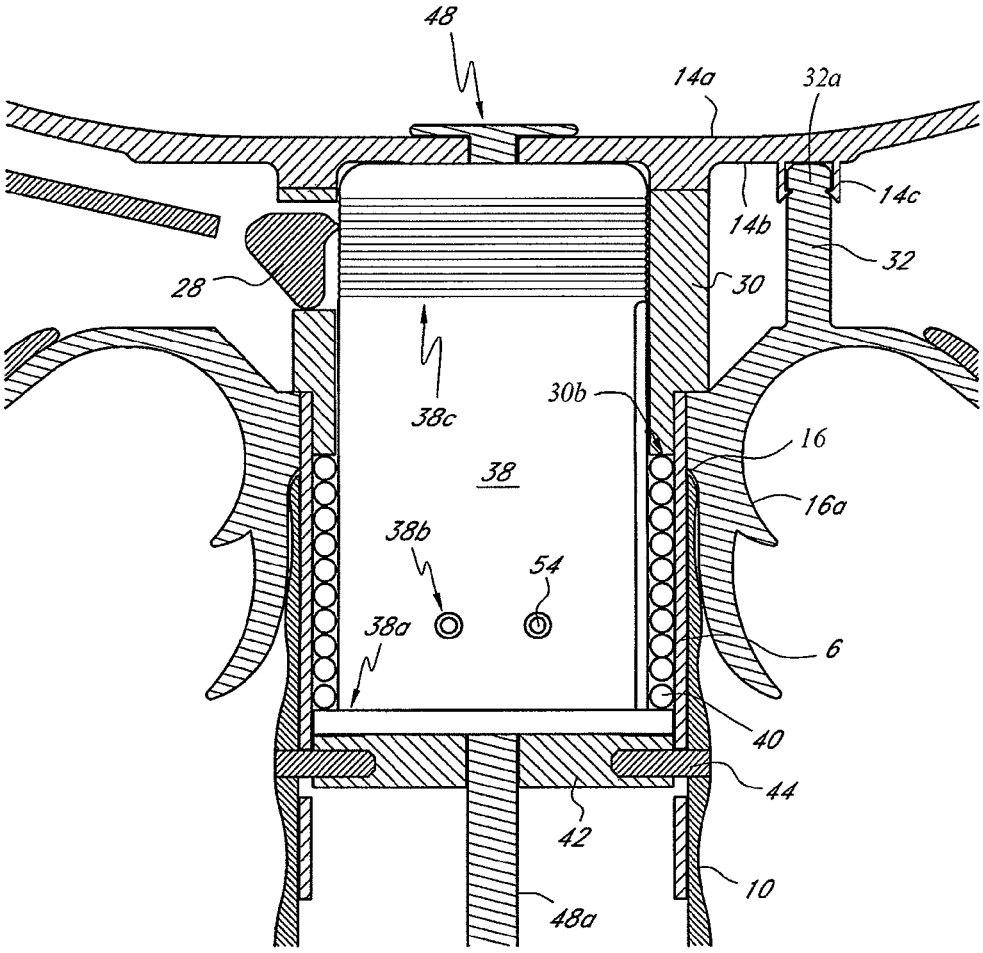
FIG. 11 is a partial cross-sectional view of the artificial flower of FIG. 1 and side view of a cam component of the artificial flower.
Figure 12:
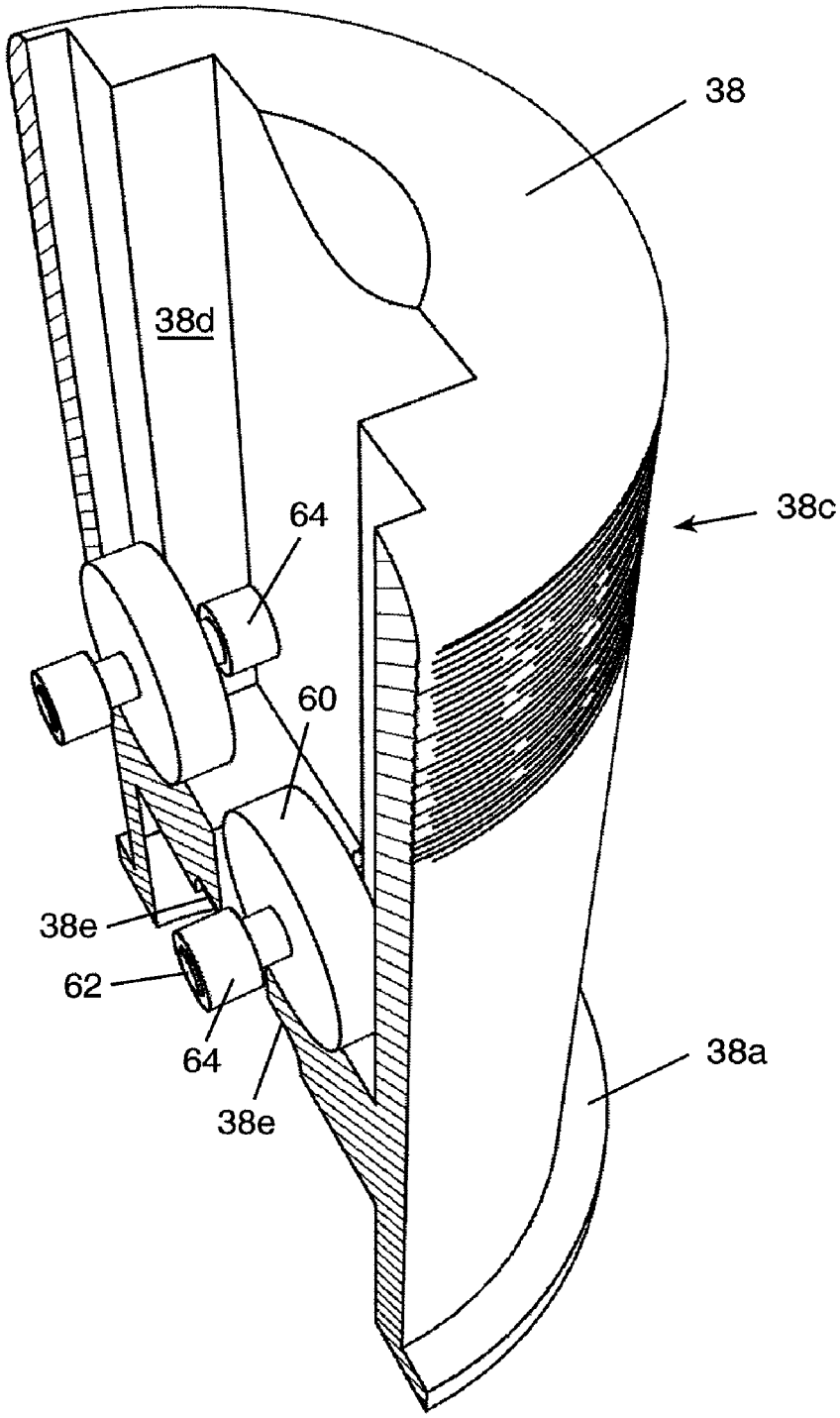
FIG. 12 is a partial cross-sectional perspective view of the cam of FIG. 11.
Figure 21:
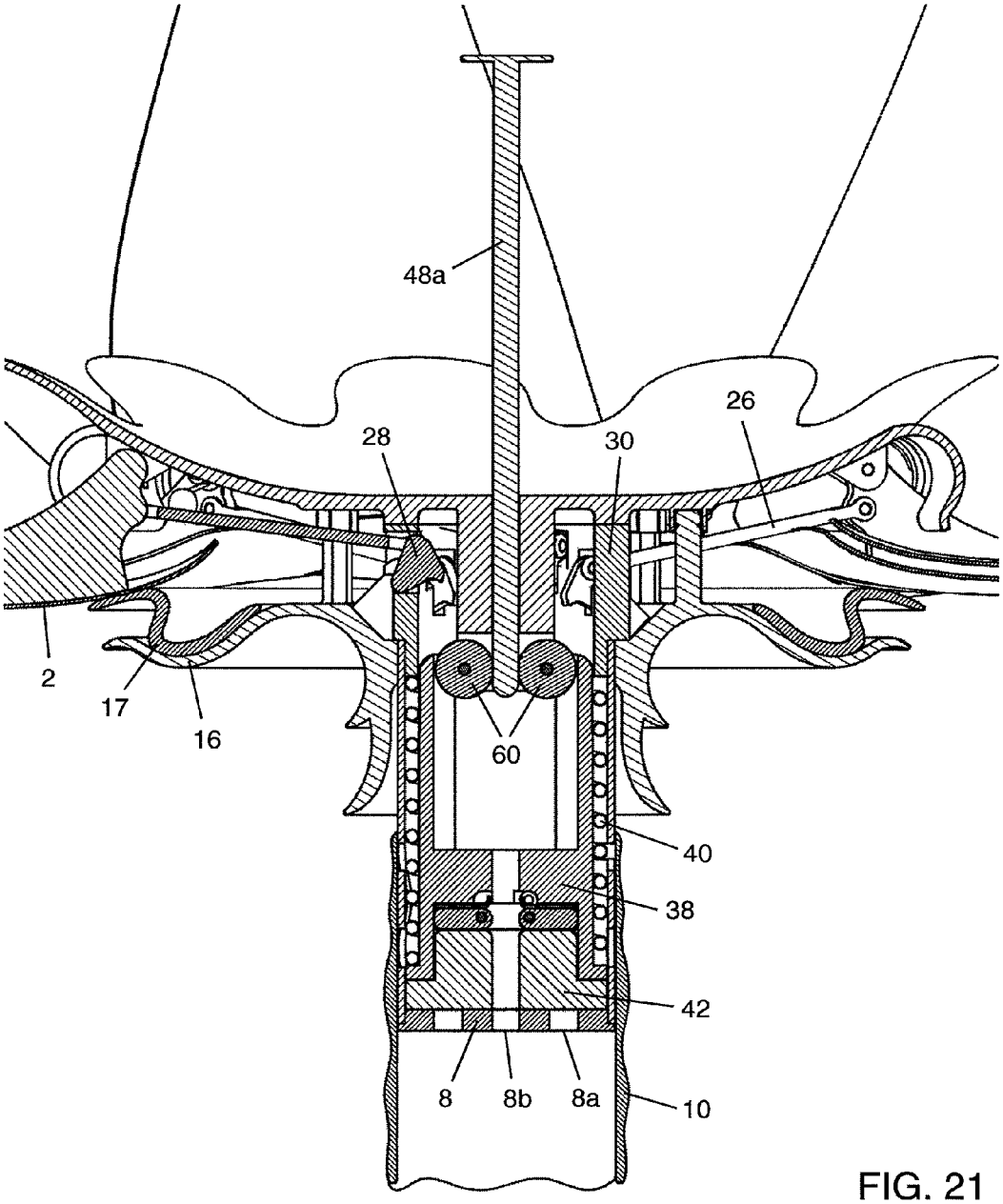
FIG. 21 is an enlarged cross-sectional side view of the animated artificial flower of FIG. 18.
Figure 22:
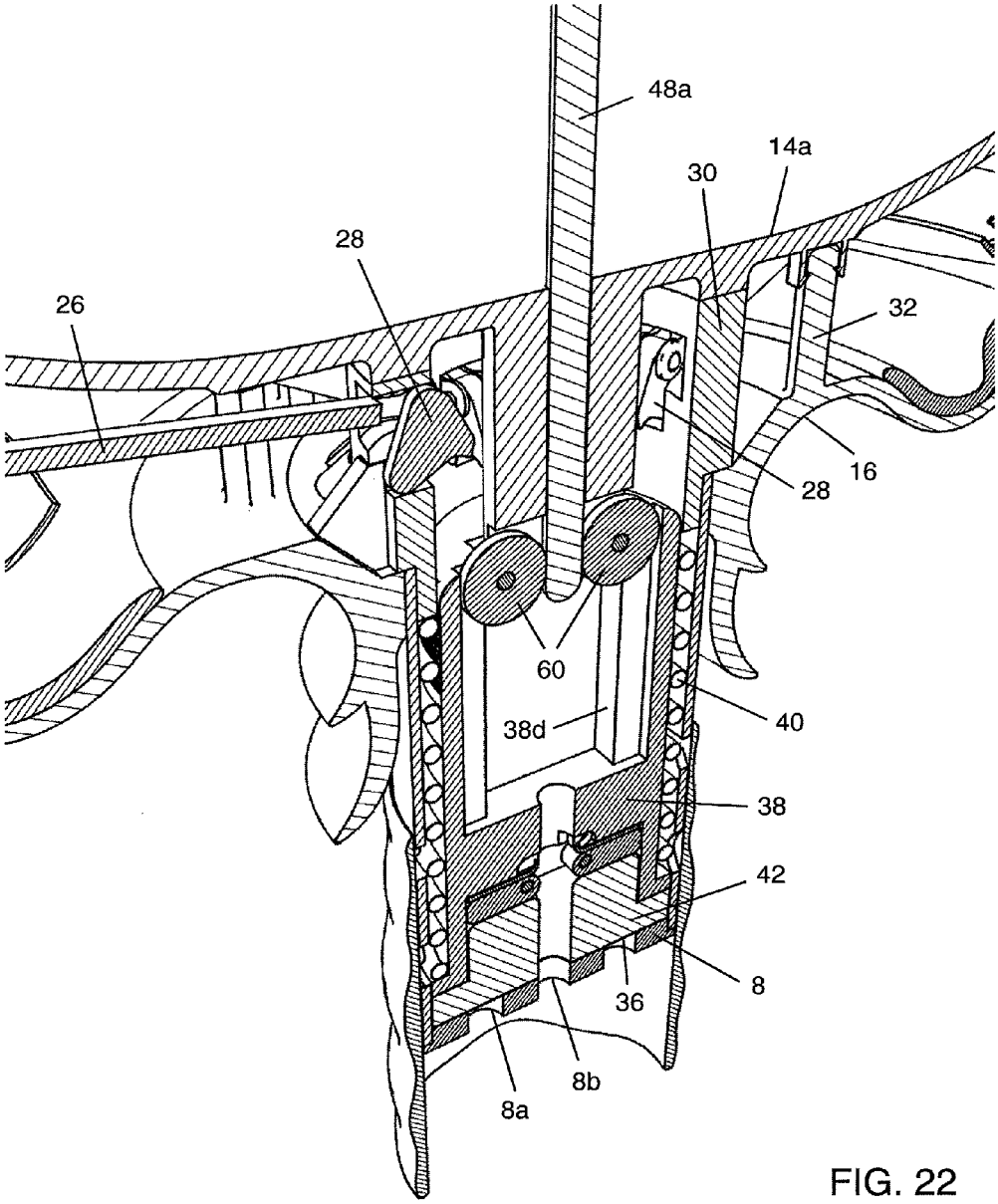
FIG. 22 is an enlarged cross-sectional perspective view of the animated artificial flower of FIG. 18.
Figure 23:
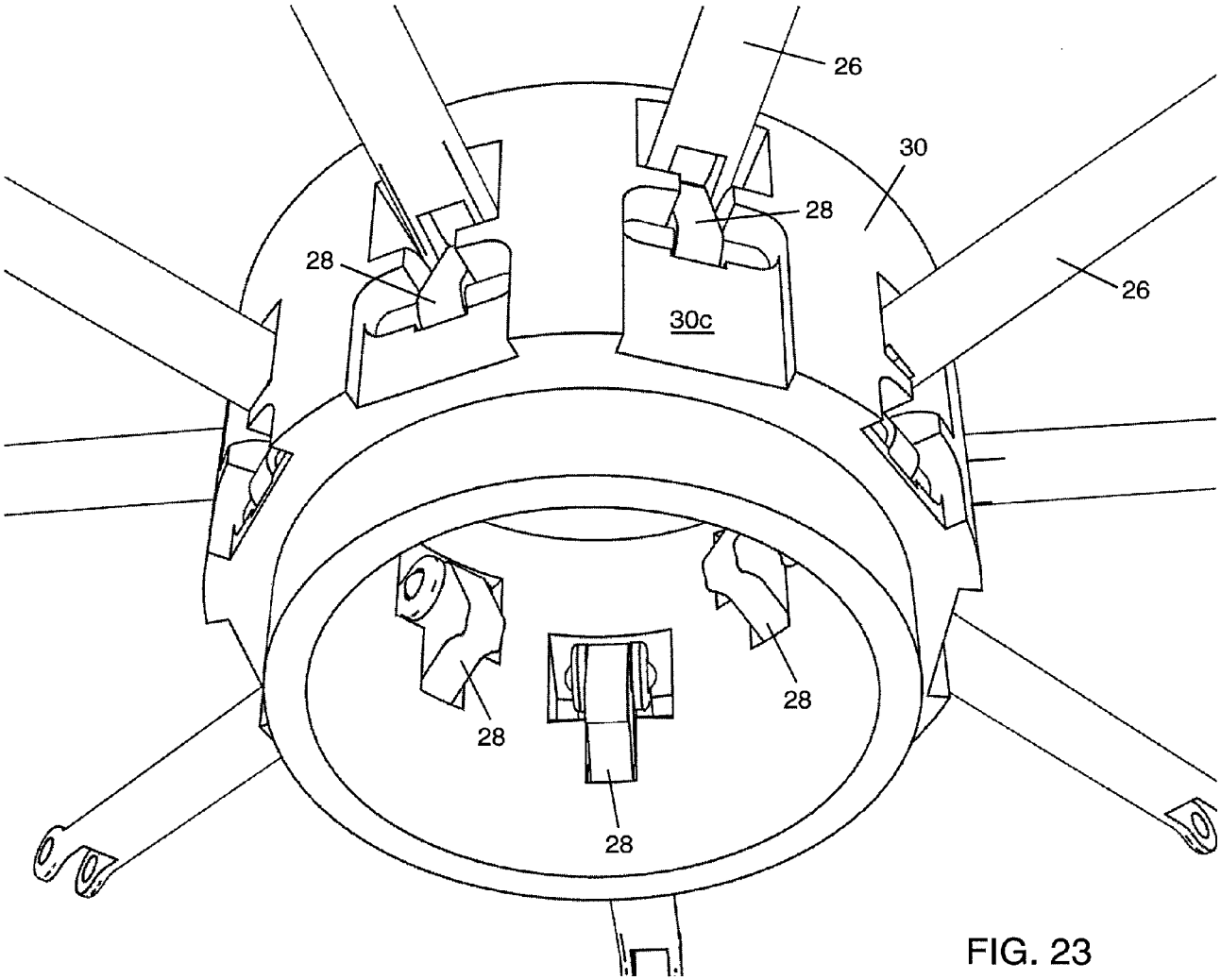
FIG. 23 is a perspective bottom view of components of the petal deploying mechanism of the artificial flower of FIG. 18.
Figure 24:
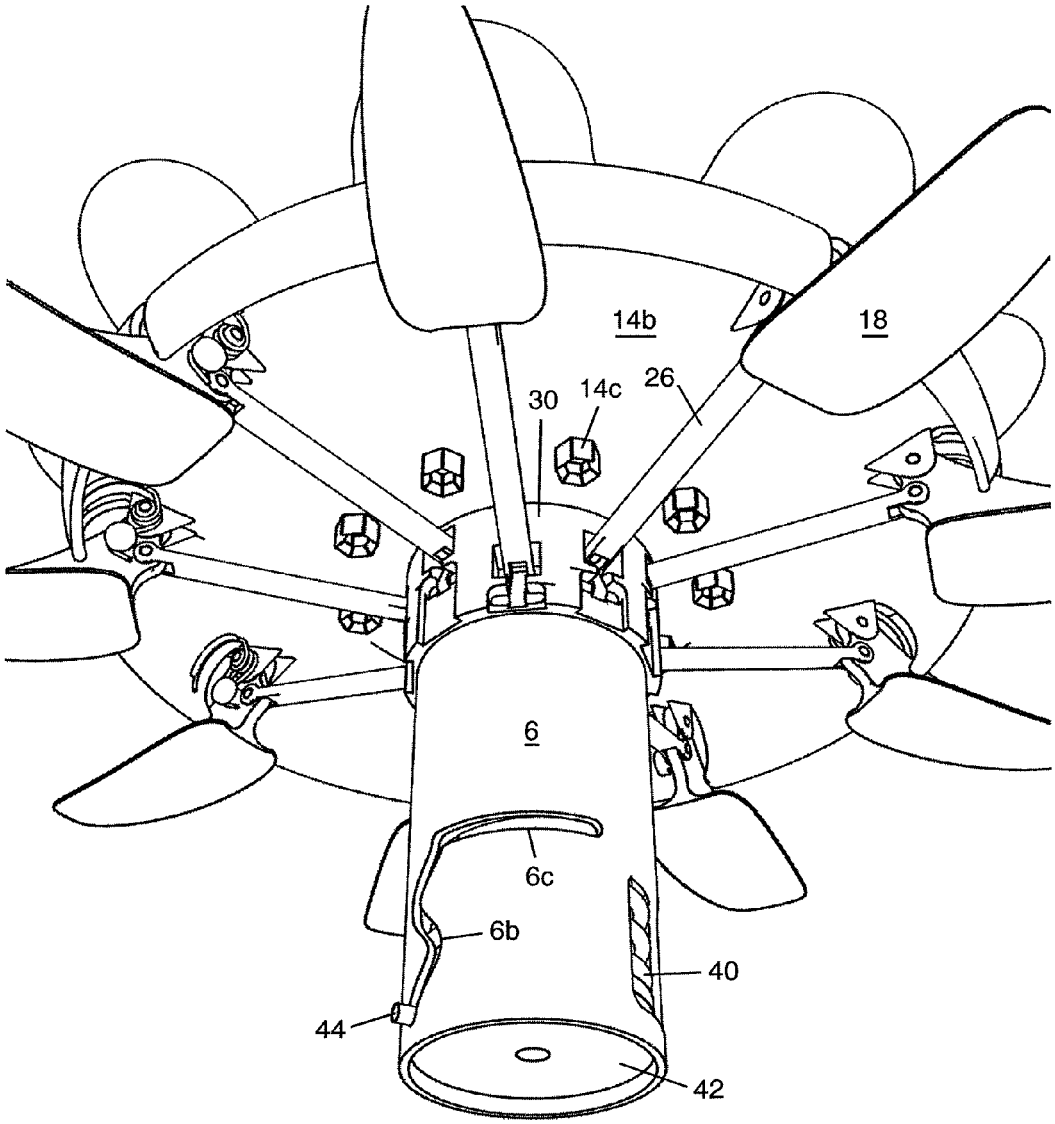
FIG. 24 is a perspective bottom view of the stem of the artificial flower of FIG. 18 with the spring in an uncompressed state.

The petal spring 20 preferably biases the corresponding petal shoe 18 so that it pivots outwardly, to thereby move the corresponding petal 2 into the opened state. When in the opened state, the petals 2 can contact (e.g., lightly contact) the cover filler 17, as shown, for example, in FIGS. 20-21. Said outward pivoting of the petal shoe 18 moves the corresponding rod 26 to pivot the lifter 28 inwardly into the lifter frame 30 when the annulus of the lifter frame 30 is unobstructed, as shown in FIGS. 21-23 and further described below. Similarly, when the lifter 28 is pivoted outwardly from the lifter frame 30, the corresponding rod 26 moves to pivot the petal shoe 18 inwardly to close the petals 2 and thereby compress the petal spring 20, as shown in FIGS. 8, 10.

With continued reference to FIGS. 4-8, the lifter frame 30, the upper cover 14, the lower cover 16, the cover filler 17, the stem 6, and the stem base 8 are preferably attached to form an assembly. Additionally, a screen 36 can be attached to the stem base 8 and within the stem 6. Unless otherwise noted, the motions of the component parts described herein is measured relative to the assembly comprising the lifter frame 30, upper cover 14, lower cover 16, cover filler 17, stem 6, stem base 8 and screen 36. In one embodiment, during animation activities (described further below) this assembly can ascend relative to the flower's 100 surrounding environment via the descent of the sleeve 10.

Figure 6:
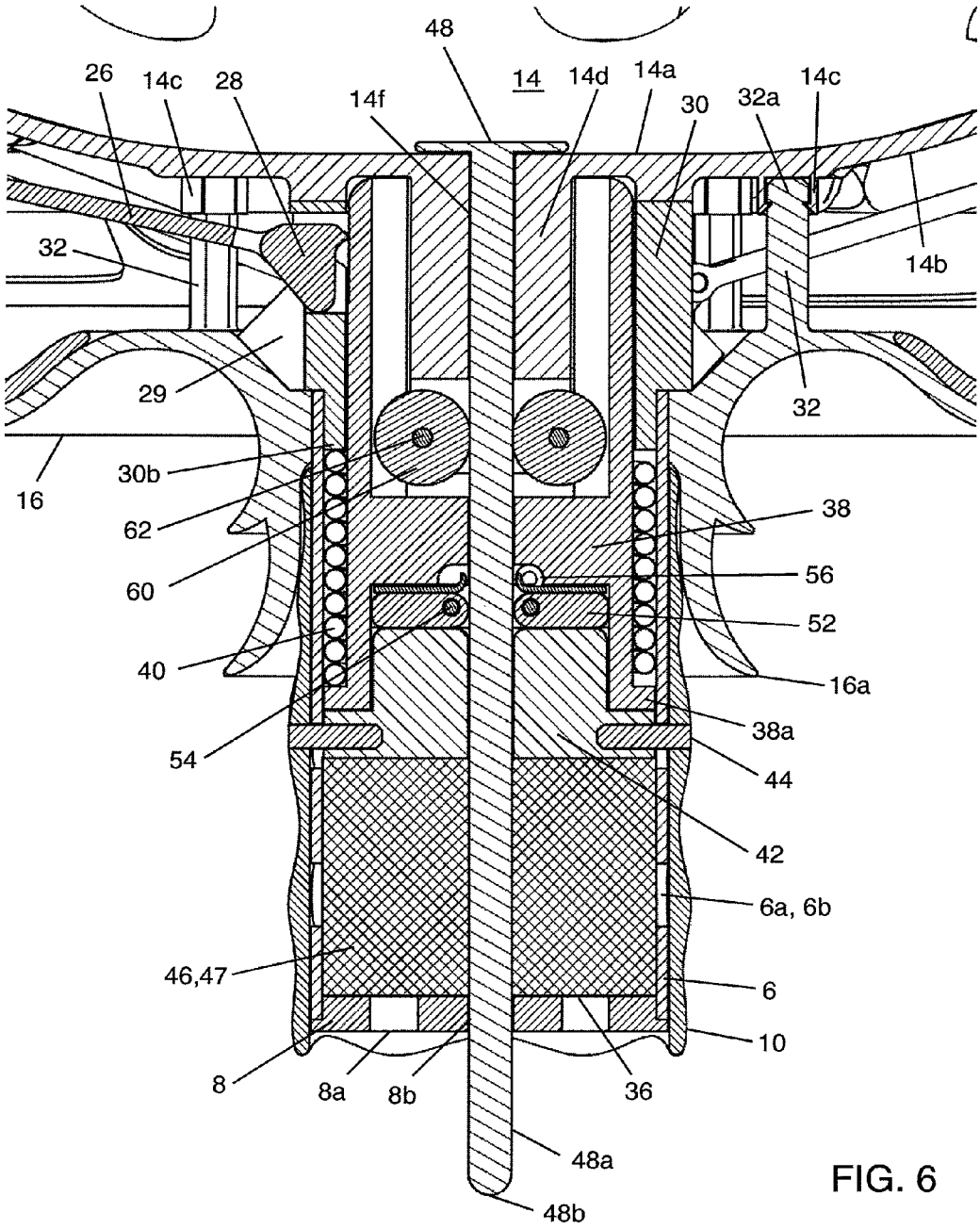
FIG. 6 is an enlarged partial cross-sectional side view of the artificial flower of FIG. 5.
Figure 7:
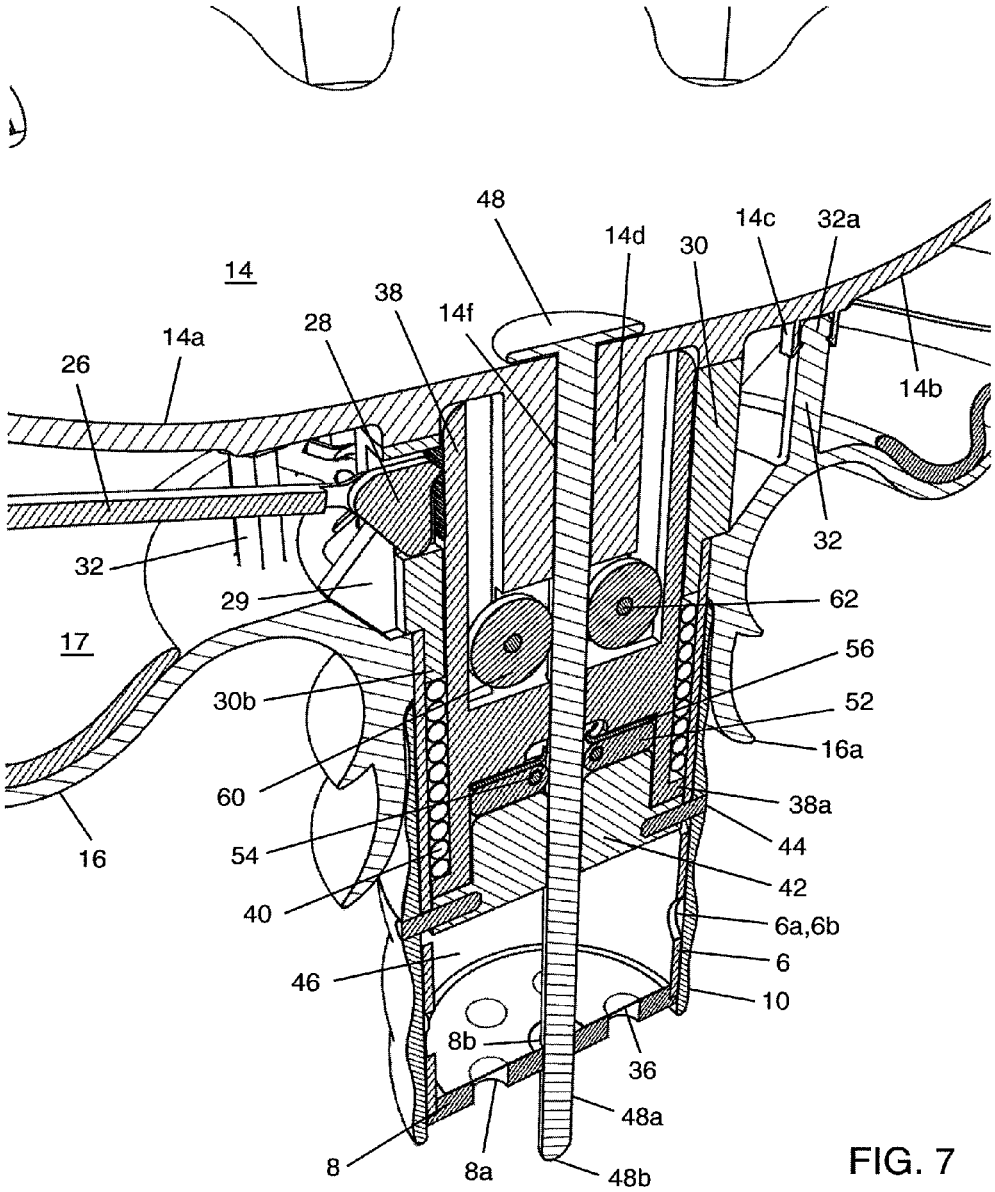
FIG. 7 is a partial cross-sectional perspective top view of the artificial flower of FIG. 1.

The screen 36 is shown, for example in FIGS. 6, 8, positioned flatly adjoining the stem base 8. In another embodiment, the screen 36 or stem base 8 can have elevating features, such as bumps, or recesses surrounding the apertures 8*a*, 8*b* in the stem base, which provide a small separating distance between the screen 36 and stem base 8, to thereby allow a greater surface area of the screen to be available for admitting the select liquid therethrough and into the stem 6. Alternatively, to further tailor the operating time, the apertures 8*a* and 8*b* in the stem base 8 can be sized and/or shaped to reduce or increase the exposed area of the screen 36.

As best shown in FIGS. 4-8, 11 and 12, the animated artificial flower 100 can have a cam 38 movably disposed within the lifter frame 30 and the stem 6. The lifters 28 can preferably each press against the cam 38 when the animated artificial flower 100 is in the closed state (i.e., the petals 2 are in the closed state). The cam 38 can slide downwardly during animation activities so as to disengage the lifters 28, thereby allowing the lifters 28 to pivot inwardly, as described above and shown in FIGS. 20-22. The cam 38 is positioned below and away from the lifters 28 when the animated artificial flower 100 is in the opened state. The cam 38 can also serve as a housing for a brake assembly 50, further described below, and as a driving surface for lifting and/or retracting a presentation platform 48.

With continued reference to FIGS. 4-8, the animated artificial flower 100 can include a piston spring 40, which can be a helically coiled resilient compression spring. The piston spring 40 can be disposed in an annulus defined between the cam 38 and the stem 6 and pressingly held in a compressed state between the lower end 30*b* of the lifter frame 30 and a flange 38*a* encircling a lower end of the cam 38.

With continued reference to FIG. 4, a piston 42 can be movably disposed (e.g., slidable) within the stem 6 and proximate the cam 38. The piston 42, under some conditions, can separate from the cam 38 and slide downwardly within the stem 6 toward the stem base 8, as shown, for example, in FIG. 17. The piston 42 can be attached to the sleeve 10 via at least one piston pin 44. In the illustrated embodiment, the piston 42 is attached to the sleeve 10 via two piston pins 44. In one embodiment, the sleeve 10 can slide over the stem 6 and stem base 8 (see FIG. 14, 15). Preferably, the piston pin 44 extends through and can slide along a corresponding piston pin track 6*a* formed in the stem 6 (see FIG. 13). In the illustrated embodiment, the piston pin track 6*a* has an undulating generally vertical portion 6*b* and a generally horizontal lock portion 6*c*. The piston pin track 6*a* advantageously accommodate the downward motion of the sleeve 10 and piston 42 during an animating activity of the animated artificial flower 100. Moreover, in the illustrated embodiment, the wave-like undulations of the generally vertical portion 6*b* of the piston pin track 6*a* causes a slight rotation of the sleeve 10 in alternating directions as the sleeve 10 descends outside the stem 6. As further discussed below, as the animated artificial flower 100 is lifted by the sleeve 10 to thereby simulate flower growth, said rotation is exhibited in other members (e.g., the petals 2) of the animated artificial flower 100.

As shown in FIGS. 4-7, a piston chamber 46 is defined as the space within the stem 6 between a lower surface of the piston 42 when fully retracted upwardly (e.g., with the piston pins 44 positioned in the lock portion 6*c* of the piston pin track 6*a*) and the assembly comprising the screen 36 and stem base 8.

Figure 13:
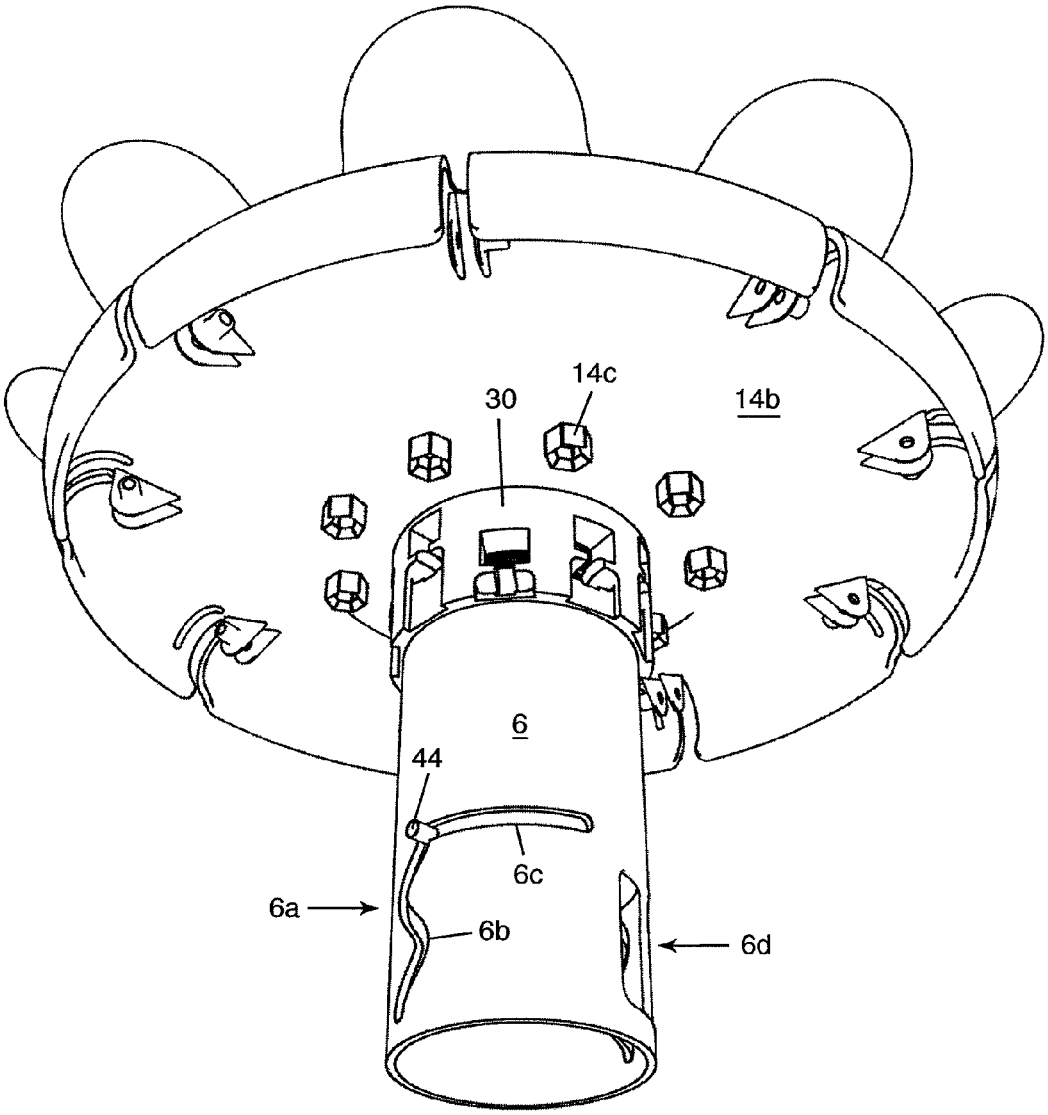
FIG. 13 is a partial perspective bottom view of a stem of the artificial flower enclosing a spring in a compressed state.
Figure 14:
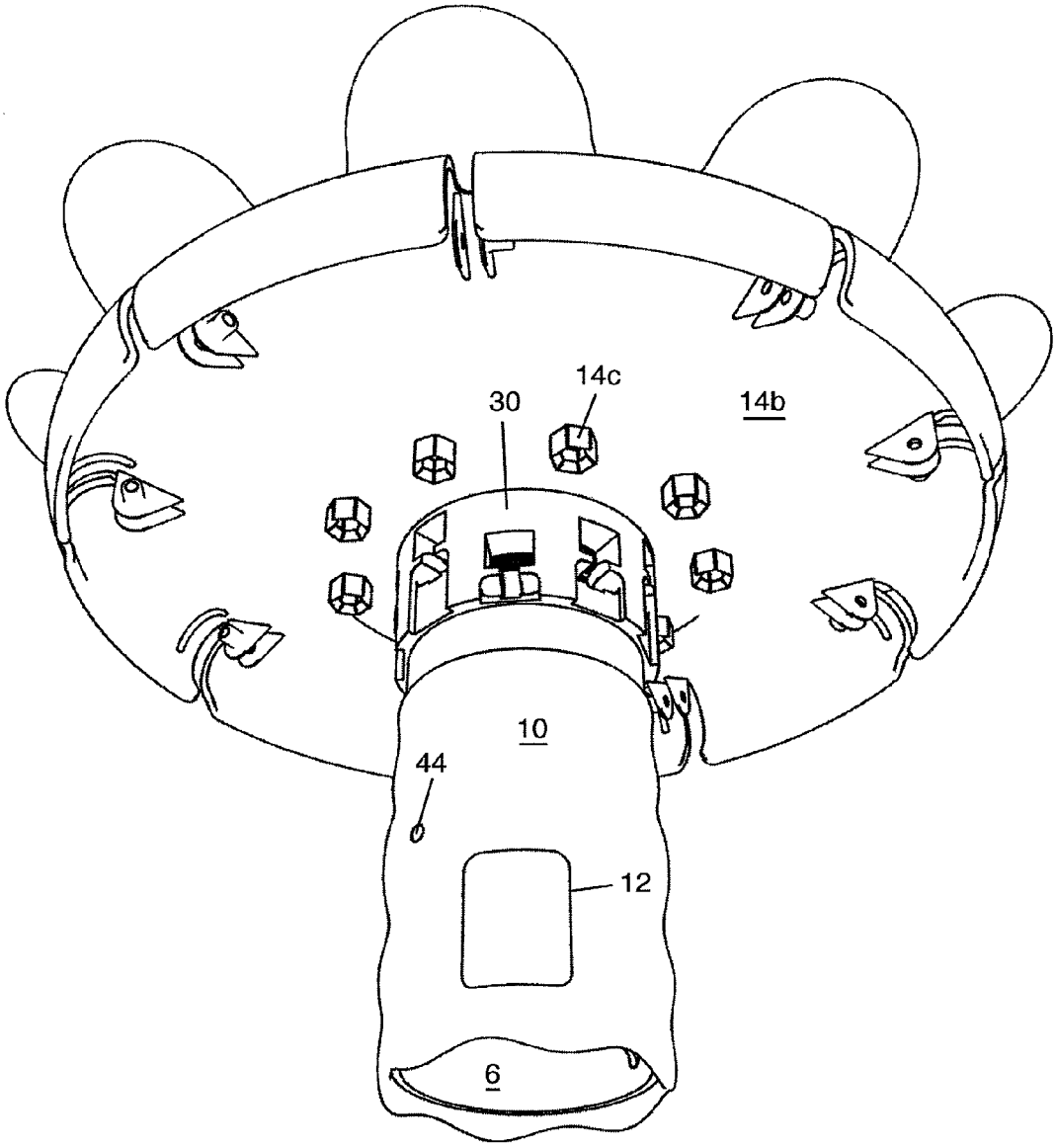
FIG. 14 is a partial perspective bottom view of the sleeve of the artificial flower disposed over the stem of FIG. 13 with the spring in the compressed state.
Figure 15:
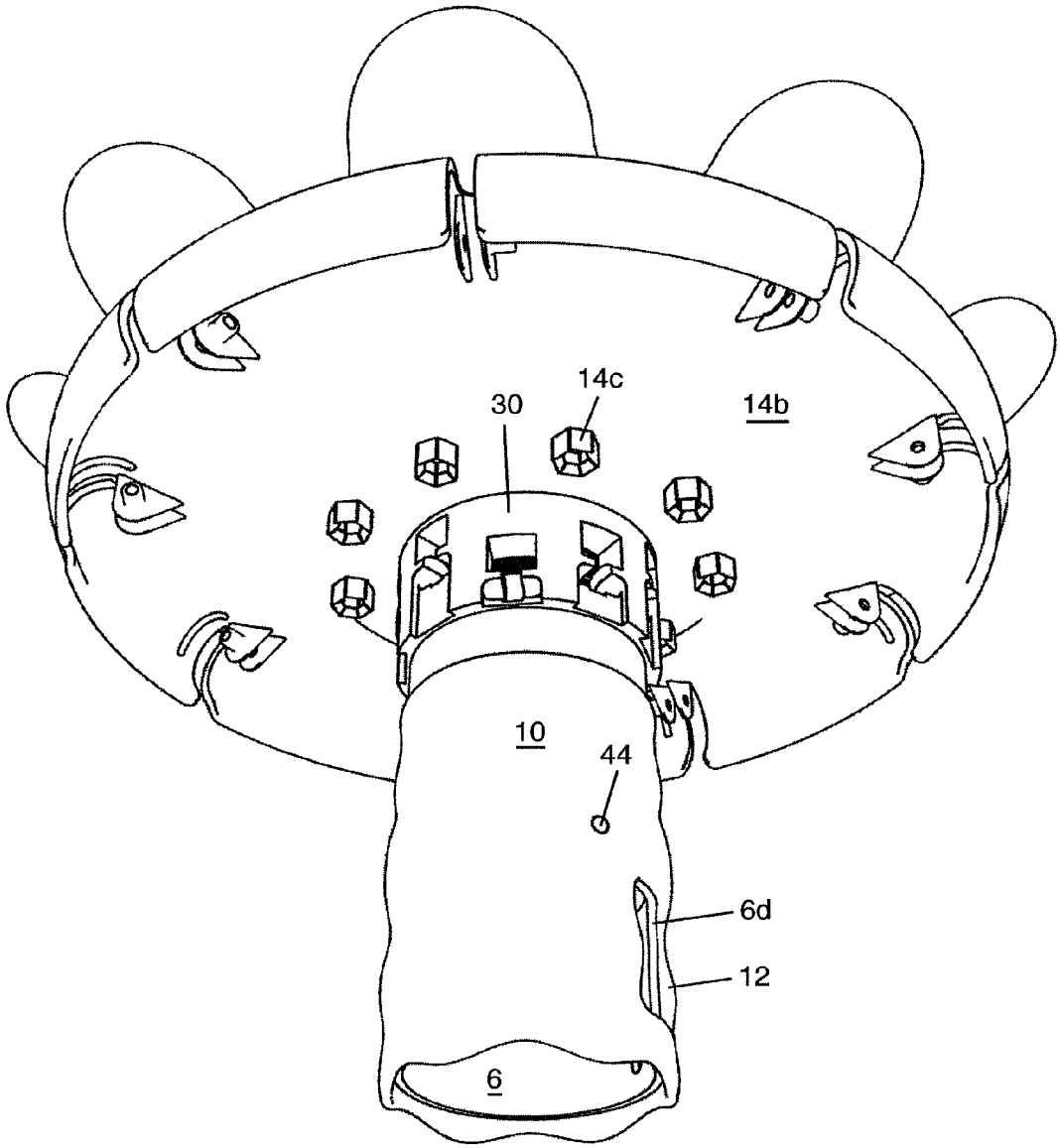
FIG. 15 is a perspective bottom view of the sleeve of the artificial flower disposed over the stem and moved into the fully locked position.
Figure 16:
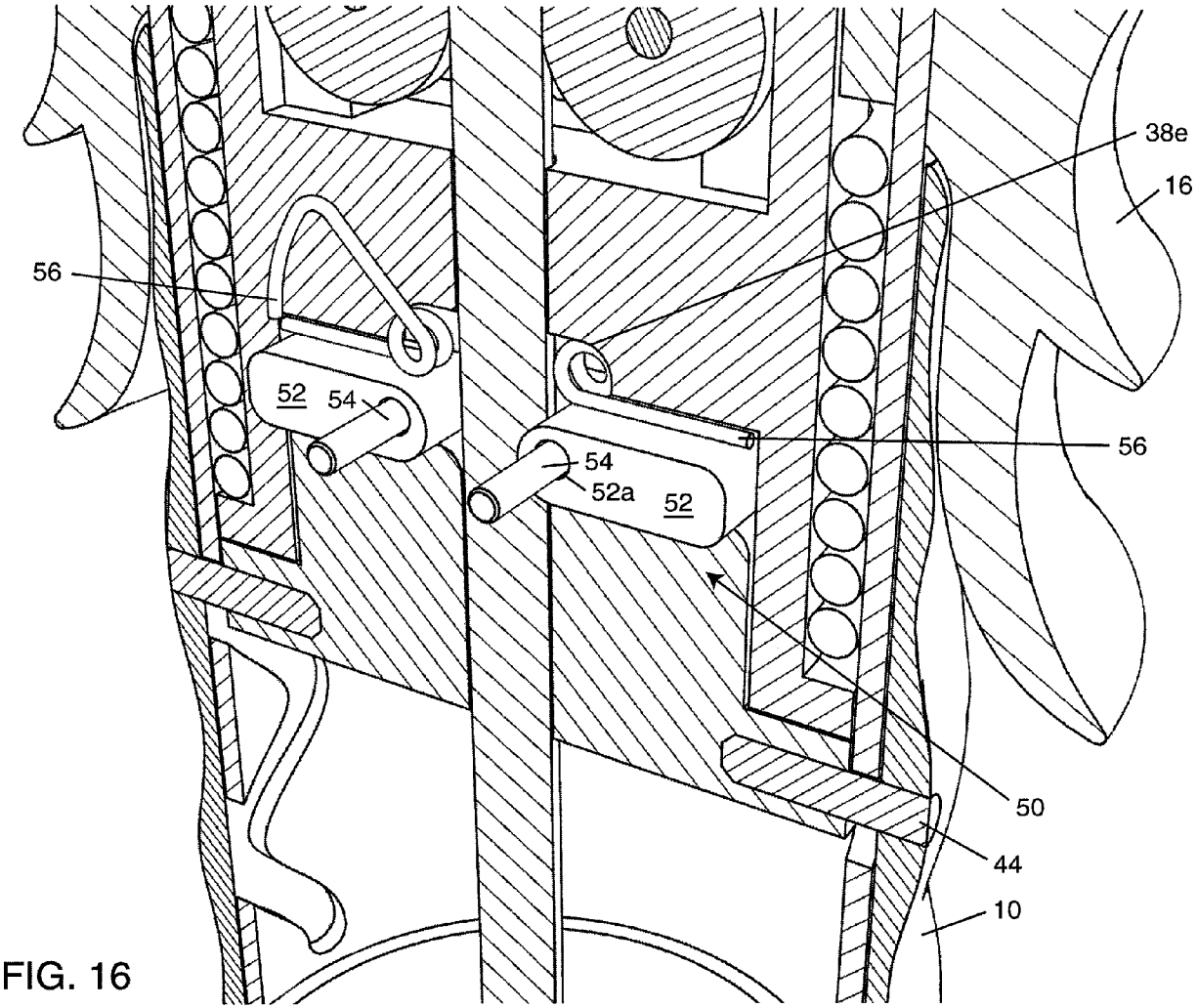
FIG. 16 is a partial cross-sectional perspective view of the artificial flower of FIG. 4 showing the brakes in a disengaged state.
Figure 17:
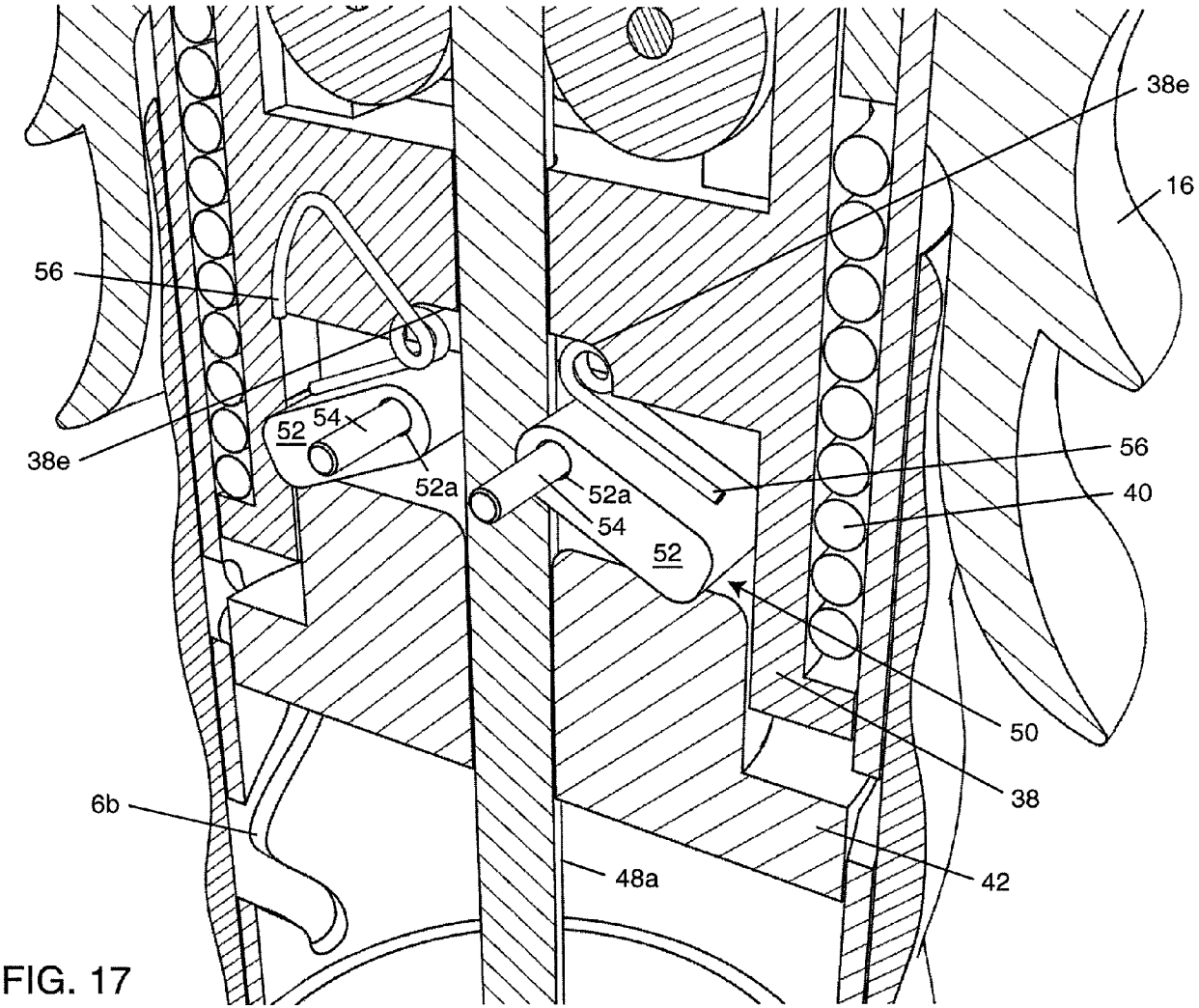
FIG. 17 is a partial cross-sectional perspective view of the artificial flower of FIG. 4 showing the deployment of the brakes.
Figure 18:
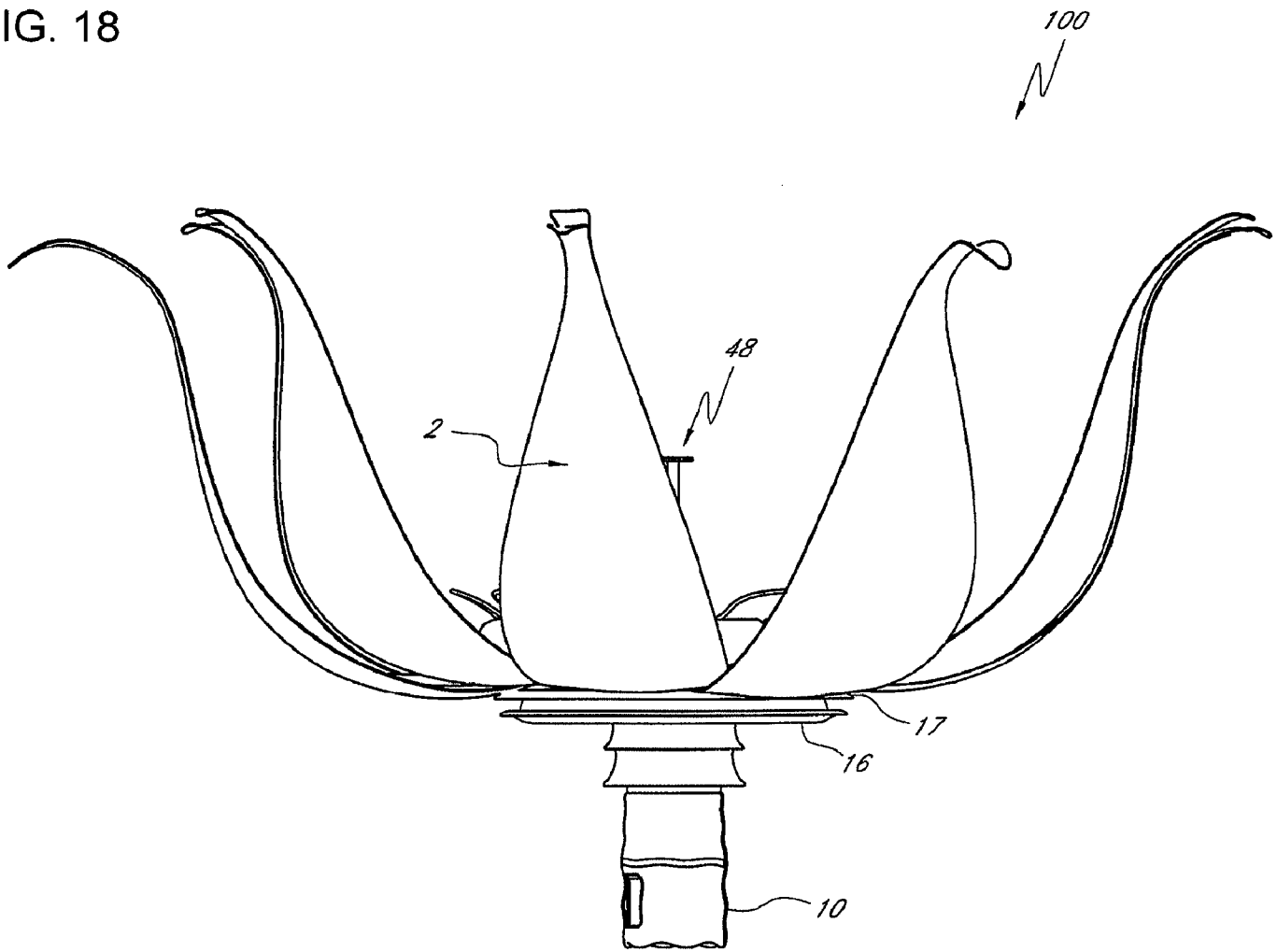
FIG. 18 is a front view of the animated artificial flower of FIG. 1 with the petals in the opened state.
Figure 19:
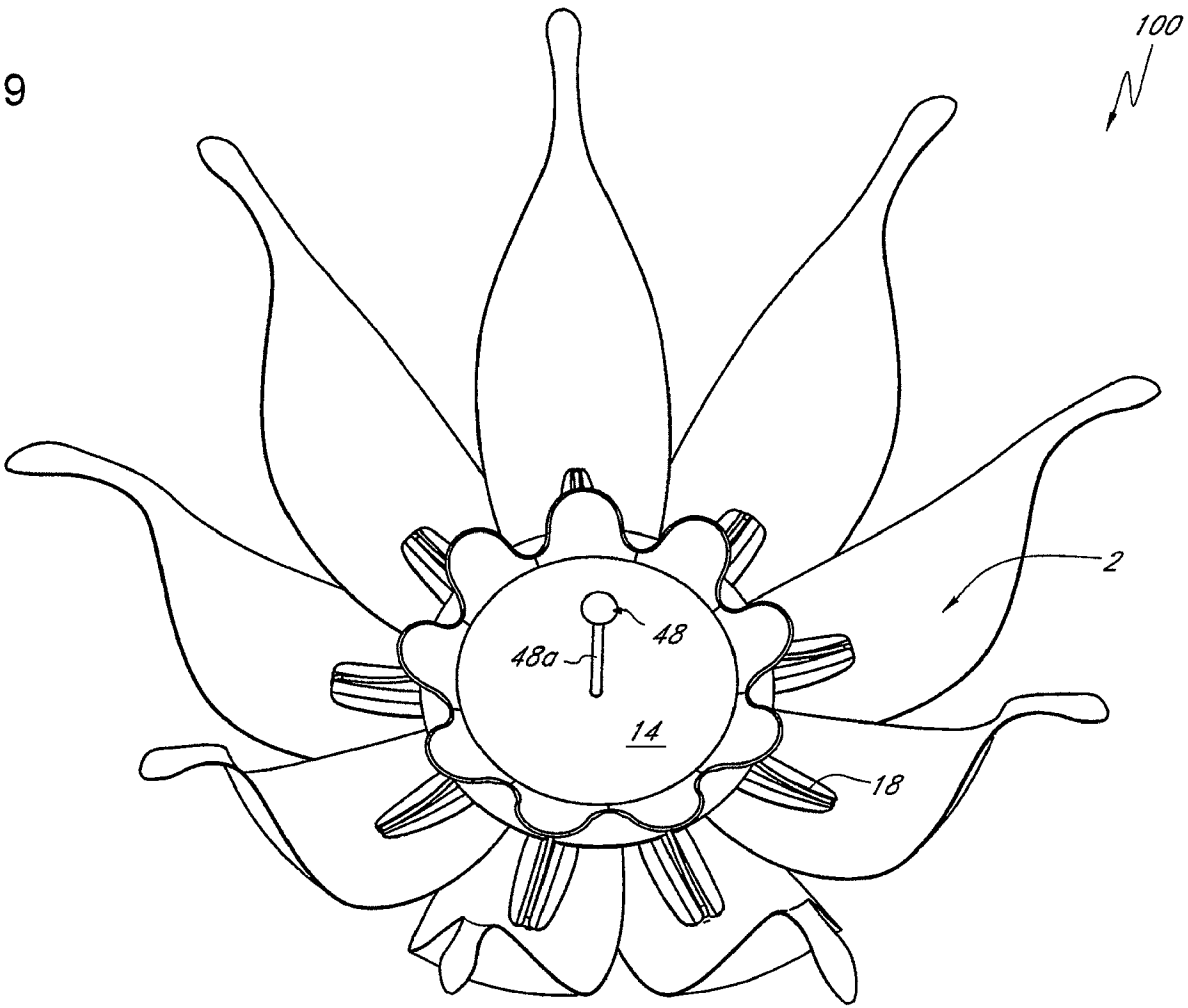
FIG. 19 is a perspective top view of the animated artificial flower of FIG. 18.
Figure 20:
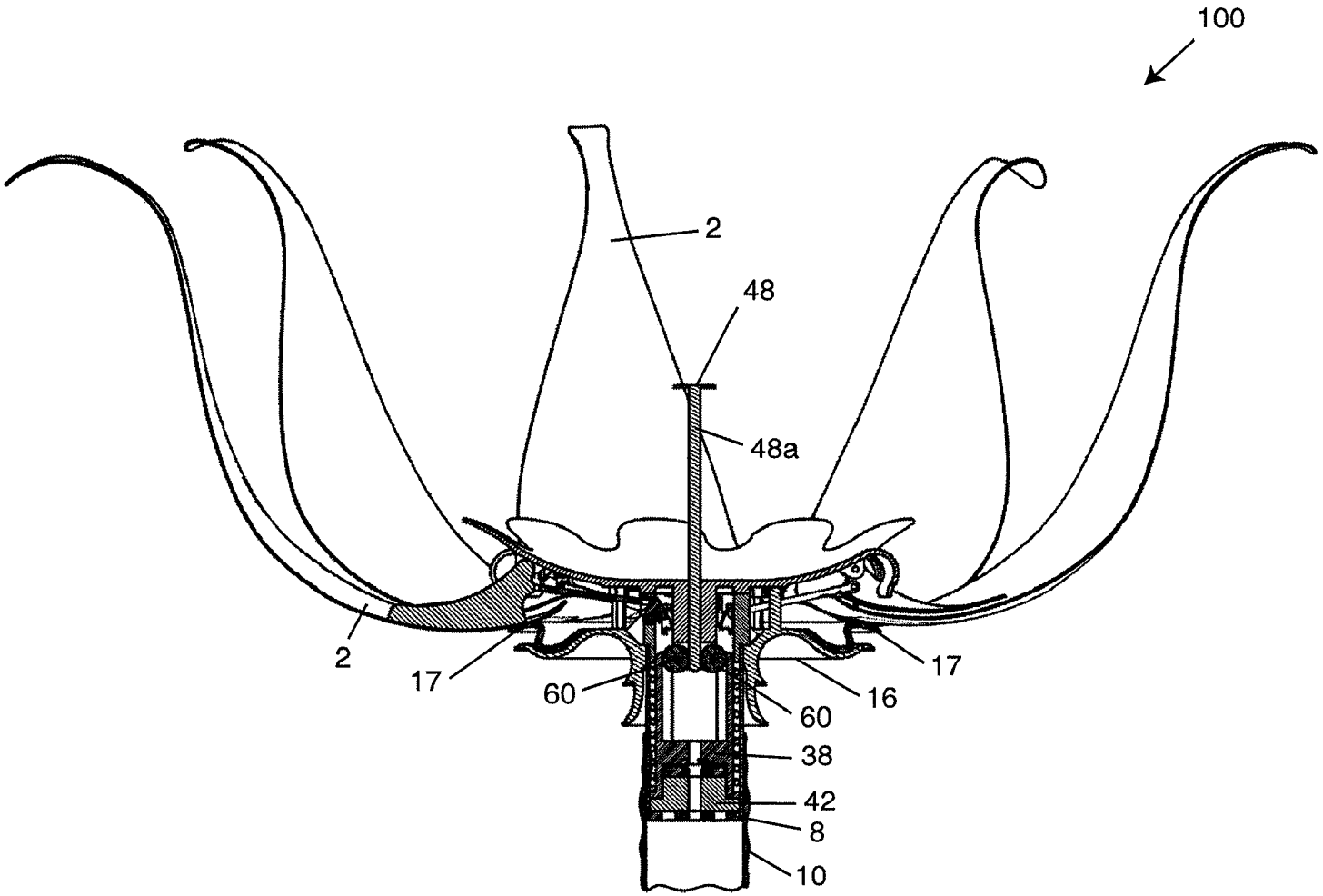
FIG. 20 is a cross-sectional side view of the animated artificial flower of FIG. 18.

The lock portion 6*c* of the piston pin track 6*a* can allow for substantial rotation of the sleeve 10 relative to the stem 6, as shown in FIGS. 14-15. In one embodiment, the sleeve 10 can be rotated (e.g., manually rotated) through this horizontal track to lock the sleeve 10 and piston 42 in a retracted position and align the opening 12 in the sleeve 10 with a corresponding stem aperture 6*d*, as shown in FIGS. 13-15, to enable filling the piston chamber 46 with an impeding agent 47 (see FIG. 4).

With continued reference to FIG. 4-8, the animated artificial flower 100 can include a presentation platform 48 that is slidably disposed through an aperture 14*f* in the upper cover 14 (e.g., through the center of the upper cover 14) and also slides through apertures in the cam 38, the piston 42, the screen 36 and the stem base 8. The presentation platform 48 can be propelled by frictional contact with at least one wheel 60 in contact with a shaft 48*a* of the presentation platform 48. In the embodiment illustrated in FIGS. 8-9, the at least one wheel 60 includes a pair of wheels 60 in contact with opposite sides of the shaft 48*a*, where the wheels 60 extend into a recessed portion of a downward protrusion 14*d* of the bottom portion 14*b* of the upper cover 14. The wheels 60 are coupled to corresponding axles 62 that can rotate in notches 14*e* in the downward protrusion 14*d*. The animated artificial flower 100 can also include a pair of wheels 64, also coupled to the axles 62, that frictionally contact an inner surface 38*d* of the cam 38 (see FIG. 12). In one embodiment the wheels 60 have a larger diameter than the wheels 64. The ratio of the diameter of wheel 60 to wheel 64 determines the ratio of the extent and rate of ascent of the presentation platform 48 to the descent of the sleeve 10. In one embodiment this ratio can be 3. In another embodiment this ratio can be set from 0.5 to 8. In the illustrated embodiment, the larger wheels 60 are centered between the two smaller wheels 64. As the cam 38 descends relative to the stem 6, the inner surface 38*d* of the cam 38 rotates the wheels 64 and 60, propelling the shaft 48*a* of the presentation platform 48 upwardly.

In one embodiment, the contact between the wheels 64 and the inner surface 38*d* of the cam 38 and the contact between the wheels 60 and the shaft 48*a* of the presentation platform 48 can be aided by materials and surface treatments that provide a high degree of friction and grip. Furthermore, in one embodiment, the notches 14*e* can be angled downwardly towards the opening thereof so that the descending inner surface 38*d* adds force directed outwardly on the axle 62, increasing the grip of the wheels 64 on the inner surface 38*d*.

With continued reference to FIGS. 5-7, 16 and 17, the animated artificial flower 100 can also include the brake assembly 50, which can include at least one brake 52 pivotally coupled to an axle that can include a brake pin 54. Brake pin 54 can be secured to the cam 38 via apertures 38*b* therein (see FIG. 11). In the illustrated embodiment, the brake assembly 50 has two brakes 52. The brake assembly 50 can include a brake spring 56 for each brake 52 comprising a resilient angular torsion spring with a helically wound portion. One end of the brake spring 56 and the helically wound portion can be disposed in a recess 38*e* in the cam 38. The other end of the brake spring 56 can press against the brake 52, providing a rotary bias force to tend to pivot the brake 52 downwardly about the brake pin 54. The brake pin 54 extends off-center through aperture 52*a* in the brake 52 such that a downward rotation of the brake 52 causes the brake 52 to press against the shaft 48*a* of the presentation platform 48 with a high degree of force. The brake 52 is typically restrained from rotation by a pressing contact from the piston 42 and can pivot to bind the shaft 48*a* of the presentation platform 48 when the pressing contact between the piston 42 and the brake 52 is diminished or removed, as shown, for example, in FIG. 17.

Upon the sudden loss of an opposing force by the piston 42 against the one or more brakes 52, which may occur during an inadvertent release of the sleeve 10 during a manual retraction thereof while the piston chamber 46 is empty, the piston 42 can be pushed away from the cam 38 by the bias force of the one or more brake springs 56 transmitted through the corresponding brakes 52. As the brake 52 pivots downwardly, the brake 52 jams into the downwardly extended shaft 48*a* of the presentation platform 48 and stops any motion thereof. The downward force on the cam 38 provided by the piston spring 40, which also forces the presentation platform 48 upwardly, adds to the binding force of the brakes 52 on the shaft 48*a*. This preferably stops all motion in the animated artificial flower 100 until the piston 42 is lifted upwardly against the brakes 52 with sufficient force to pivot the brakes 52 up and away from the shaft 48*a*.

The petals 2 can have a plurality of sizes and positions. Each petal shoe 18 can also be sized and shaped for the attached petal 2, setting the petal 2 at the appropriate distance from the center of the animated artificial flower 100 to provide overlap in the petals 2. The pivotal position of the petal shoe 18 can be determined by the pivotal position of the corresponding lifter 28 as transmitted by the petal rod 26. As discussed above, the petal spring 20 between each petal shoe 18 and the upper cover 14 biases the related petal 2 in an open position and applies an inwardly directed force on the related petal rod 26 and lifter 28. In another embodiment, the petals 2 may be so configured by weight distribution that they open by the force of gravity instead of by using petal springs 20. The petals 2 can be shaped with a greater horizontal radius (i.e., less curvature) towards their lower ends to allow a close spacing and overlap of the petals 2 when opened.

When the animated artificial flower 100 is in the open position, as shown in FIGS. 18-24, the petals 2 can rest upon the cover filler 17, which in one embodiment can be resilient and flexible. The cover filler 17 advantageously provides a soft stop for the open petals 2. In one embodiment, deformation of the cover filler 17 allows the petals 2 to be manually forced open beyond the fully open position by a substantial degree without breakage. In another embodiment, the petals 2 cannot be pulled open while in the closed state without breakage but may be readily closed while in the opened state by an application of a manual force thereupon.

The lifters 28 can be differentiated into groups by, for example, position. As shown in FIGS. 10 and 23, a lifter 28 can be set at an elevation in the lifter frame 30 that differs from an elevation of another lifter 28. The elevation of the lifter 28 in the lifter frame 30 can determine the starting time of opening of the corresponding petal 2. The petal rods 26 can be adapted by length to accommodate the position of the lifters 28. In the illustrated embodiment, the position of the lifters 28 can influence the relative starting times of opening of the petals 2 but does not substantially influence or limit the relative extent of opening of the petals 2.

When the animated artificial flower is in the closed position, the lifters 28 normally press against the cam 38, as shown in FIGS. 4-8 and 11. The radius of the outer surface of the cam 38 at the point of contact with each lifter 28 sets the angle of the lifter 28 and thereby the position of the corresponding petal 2. Circumferential grooves 38*c* (see FIGS. 11, 12) can surround the cam 38. As the cam 38 slides downwardly past the lifters 28 due to a change in the state of the impeding agent 47 in the piston chamber 46 (e.g., a reduction, by dissolution, of the effective size of the impeding agent), the grooves 38*c* can impart an oscillatory motion to the lifters 28. This oscillatory motion can be transmitted to the petals 2 through the petal rods 26, thereby causing the petals 2 to vibrate. In one embodiment, the distance between each elevation of lifters 28 may be equal to an integer multiple of the cam groove period plus the cam groove period divided by the number of groups of petals 2 (e.g. grouped by relative size and/or distance from center, as described more fully below), thereby causing the vibration between groups of petals 2 to be in different phases. In another embodiment (not shown), the grooves 38*c* can have irregular variations and eccentric twists and the outer surface of the cam 38 can narrow gradually towards the top end thereof to add greater variety to the position and vibration of the petals 2 as they open.

In the illustrated embodiment, as the top surface of the cam 38 moves downwardly past each elevation of lifters 28, the lifters 28 pivot inwardly (e.g., as a result of the bias force applied by the petal spring 20), as shown in FIG. 23, and the petals 2 controlled by those lifters 28 move into the opened state. In the illustrated embodiment, the petals 2 are fully opened when the cam 38 is fully withdrawn downwardly and no longer contacts the lifters 28.

In the illustrated embodiment, the lifters 28 are shown having a uniform size. Optionally, the lifters 28 can have varying sizes, varying at least by the distance from the axis of the pivotal connection to the tip of the lifter 28 which contacts the cam 38. Such lifters 28 of varying size can be used to provide a variation in the rate of opening of the petals 2.

In one embodiment, the slidable engagement between the shaft 48*a* of the presentation platform 48 and the aperture 14*f* through the central downward protrusion 14*d* of the upper cover 14 can be smooth, providing for a linear ascent of the presentation platform 48. In another embodiment (not shown), the aperture 14*f* and the shaft 48*a* can be threaded with mating helical screw threads to provide rotation to the presentation platform 48 as it ascends.

With continued reference to FIGS. 4-8, the at least one aperture 8*a* in the stem base 8 can admit a select liquid therethrough into the piston chamber 46. The screen 36 is preferably porous, readily admitting the select liquid while retaining the impeding agent in the piston chamber 46. As the animation activities progress, the portion of the downwardly extended shaft 48*a* of the presentation platform 48 that protrudes through the central aperture 8*b* in the stem base 8 (see FIGS. 3 and 4), is pulled upwardly and withdrawn into the stem 42. Said upward movement of the shaft 48*a* can in one embodiment cause the animated artificial flower 100 to briefly descend and straighten before the lowering sleeve 10 contacts the bottom of the surrounding container and begins to lift the animated artificial flower 100. As the ascending shaft 48*a* of the presentation platform 48 exposes the aperture 8*b* in the stem base 8 (see FIG. 14), the undissolved impeding agent may readily escape through the aperture 8*b*, reducing the operating time of animation of the animated artificial flower 100.

In one embodiment, to prepare the animated artificial flower 100 for operation, the user may first hold the opened flower 100 in one hand by a lower portion 16*a* of the lower cover 16. With the other hand, the user can take the sleeve 10 and push it upwardly to a first stop (i.e., where the piston pin 44 is at the upper end of the vertical portion 6*b* of the piston pin track 6*a*) and then twist it to a final stop (i.e., where the piston pin 44 is at the closed end of the lock portion 6*c* of the piston pin track 6*a*), as shown in FIGS. 13-15. This action performs at least one of: compressing the piston spring 40, closing the petals 2 of the animated artificial flower 100 (see FIG. 1), retracting the presentation platform 48 downwardly, locking the vertical position of the sleeve 10 and aligning the opening 12 in the sleeve 10 with the aperture 6*d* of the stem 6. The user may then insert the impeding agent 47 through the aligned opening 12 and aperture 6*d* and into the piston chamber 46 (e.g., by turning the animated artificial flower 100 to its side to insert the impeding agent 47). When finished filling the piston chamber 46, the user may twist the sleeve 10 back to the first stop, thereby closing the piston chamber 46, by moving the opening 12 of the sleeve 10 out of alignment with the aperture 6*d* of the stem 6, and unlocking the sleeve 10.

Animation activities of the closed and loaded flower 100 may then be actuated by exposing the piston chamber 46 to a select liquid. For example, the animated artificial flower 100 can be placed into a container containing the select liquid so that the stem 6 is at least partially submerged in the select liquid. In another embodiment, the animated artificial flower 100 can be placed into the container, which is thereafter at least partially filled with the select liquid so that at least a portion of the stem 6 is immersed in the liquid. Preferably, the container bearing the select liquid has a narrow upper opening to prop the animated artificial flower 100 in a roughly vertical position so it will not tip over. Additionally, the container should preferably be shallow enough to allow the animated artificial flower 100 to rest on its lowest point. The degree of initial positional instability can be adjusted by extending the outside diameter and/or length of the sleeve 10 such that the closed flower may stand generally or fully upright without any additional support, and/or the ratio of the diameter of wheel 60 to wheel 64 can be reduced so that the length of the shaft 48*a* can be reduced.

The select liquid infiltrates the piston chamber 46 through the stem base 8 and screen 36. This changes the effective size of the impeding agent 47. For example, where the impeding agent 47 is a dissolvable material, exposure of the impeding agent to the select liquid will dissolve the impeding agent. As the effective size of the impeding agent in the piston chamber 46 gradually diminishes, the piston spring 40 can expand until it forces the piston 42 into contact with the stem base 8 (see FIG. 24). The piston spring 40, pushing on the cam 38, moves it downwardly through the lifter frame 30 and the stem 6 to drive animation activities of the artificial flower 100. The animated artificial flower 100 demonstrates animation activities comprising simulated growth, vibration of the petals 2, the opening of the corolla 4 (e.g., movement of the petals 2 to the opened state), rotation of the corolla, and an ascent of the presentation platform 48, which in one embodiment can present a surprise object (e.g., a gift).

In the illustrated embodiment, during the animation activity of the animated artificial flower 100 and before presenting simulated growth, the animated artificial flower 100 can manifest a small gradual reduction in total height and a vertical straightening for dramatic effect as the downwardly protruded shaft 48*a* of the presentation platform 48 is withdrawn upwardly through the stem base 8 and into the stem 6 by the upward motion of the presentation platform 48.

As the presentation platform 48 ascends, the sleeve 10 descends, as discussed above. As the lower end of the sleeve 10 descends beyond a lower end 48*b* (see FIGS. 3, 20-22) of the ascending presentation platform 48, the sleeve 10 becomes the supporting base upon which the animated artificial flower 100 stands vertically upright. A continued downward extension of the sleeve 10 causes the other members of the flower 100 to lift, thereby exhibiting a simulation of natural growth of the animated artificial flower 100.

The simulated growth can continue during the other animation activities (e.g., opening of the corolla 4, lifting of the presentation platform 48) of the animated artificial flower 100. During simulated growth, the animated artificial flower 100 continually manifests a gradual rotary oscillation of preferably a few degrees about a central vertical axis thereof as a result of the movement of the piston pin 44 within the undulating generally vertical portion 6*b* of the piston pin track 6*a* in the stem 6, as discussed above.

In the illustrated embodiment, the petals 2 of the corolla 4 are organized into three groups of three petals 2 each, with inner petals 2*a*, middle petals 2*b* and outer petals 2*c*. Of course, other numbers of petals 2 and groups may be used and can be differentiated by size and position. In this embodiment, the middle petals 2*b* can be situated at a greater distance from the center of the animated artificial flower 100 than the inner petals 2*a*, and each middle petal 2*b* can overlap with at least one side edge a side edge of an inner petal 2*a*. Outer petals 2*c* can be situated at a greater distance from the center of the animated artificial flower 100 than the middle petals 2*b* and each outer petal 2*c* can overlap a side edge of a middle petal 2*b* and a side edge of an inner petal 2*a*.

As the simulated growth of the animated artificial flower 100 continues, the petals 2 start to open. The outer petals 2*c* open first. While the outer petals 2*c* are opening, the middle petals 2*b* start opening followed by the inner petals 2*a*. In the illustrated embodiment, from the start of animation activities and before each petal 2 opens, each petal 2 can gradually vibrate between the closed position and a slight opening thereof, due to the interaction of the lifters 28 with the circumferential grooves 38*c* of the cam 38, as discussed above. The vibration of the outer petals 2*c*, middle petals 2*b* and inner petals 2*a* can occur at differing phases of a similar frequency.

A cavity 34 is defined within the closed corolla 4 and can at least partially conceal a surprise object (e.g. a gift) when the corolla 4 is closed. The surprise object can be coupled to the presentation platform 48 and revealed rising through the center of the corolla 4 as the petals 2 open. In the illustrated embodiment, the rate and extent of ascent of the presentation platform 48 is greater than the rate and extent of descent of the sleeve 10. In another embodiment, the rate and extent of ascent of the presentation platform 48 is equal to the rate and extent of descent of the sleeve 10 (e.g., where the wheels 60 and 64 have the same diameter). In still another embodiment, the rate and extent of ascent of the presentation platform 48 is less than the rate and extent of descent of the sleeve 10 (e.g., where the wheels 64 have a larger diameter than the wheels 60).

In one embodiment, the animated artificial flower 100 can advantageously be reused, by refilling the piston chamber 46 with an impeding agent, such as in the manner described above.

In the drawings and illustrations referenced herein, the embodiments are not necessarily drawn to scale, but rather are drawn to enable clear visualization of the component parts while imparting the general appearance of a natural flower. Natural flowers exist in a great variety of types and proportions. Some have short stocky stems. Some can have asymmetric petals, petals that vary widely in shape, only one petal or even petals not readily recognizable as such. Though the term "corolla" is commonly used to describe a plurality of petals, in a flower having one petal, one petal will constitute a corolla.

The drawings in this specification do not limit the invention to only those embodiments that generally resemble the illustrations. For example, the embodiments can be enhanced for additional realism or variety by altering the shapes and proportions of the component parts, or by attaching additional petals, sepals, petioles, leaves, nodes, branches, thorns or the like to the stem, perianth or other parts of the embodiments. Such additional components can be added alone or in combination. The inclusion of some such enhancing features in some of the embodiments herein by drawing and description is illustrative only and not limiting.

Moreover, the invention is not limited to embodiments that are intended to convey the beauty of natural flowers, or faithfully replicate the appearance or proportions thereof. An artificial flower can resemble a natural flower in a general sense without closely resembling a particular species of natural flower. It is contemplated that the various embodiments disclosed herein can be crafted as works of creative art to appear unlike existing natural flowers, or can include unnatural cartoonish features and fantastic embellishments, including a decorative base or stand.

Certain embodiments, though referred to herein throughout the specification and appended claims by the term "flower", bear little or no resemblance to a natural flower. Likewise, certain components, though identified herein throughout the specification and appended claims by a label that also identifies a part of a natural flower, can take other forms or serve other functions. For example, when practiced for use as a child's toy, the embodiments of the invention disclosed herein can resemble a bivalve mollusk, dinosaur, octopus, boat, mermaid, or the like. In such embodiments, the petal can resemble a shell of the bivalve, jaw of the dinosaur, tentacle of the octopus, sail of the boat, tail of the mermaid, or the like. The stem can resemble a siphon or foot of the bivalve, body of the dinosaur, head and visceral mass of the octopus, hull of the boat, body of the mermaid, or the like. Such embodiments can be operated fully or partially submerged, and the advancing motion of the piston can be employed in a mechanical apparatus, for example, as a manner of propulsion. Thus, the invention is not limited to use in artificial flowers as commonly understood.

The use of a flat type, helically coiled type, compression type, expansion type, spiral wound or other type of resilient spring in the embodiments herein is not limiting. A specification of a specific resilient spring type shall be understood as one option only and does not exclude other options. Other spring types or resilient member types can be used in alternative positions and configurations to provide similar functional benefits.

The use of an inner stem slidably disposed within a stem to present flower growth and opening is not limiting. A specification of an attachment of, for example, a corolla to an inner stem shall be understood as one option, and does not exclude other options. For example, instead of an inner stem, an "outer stem" or other alternative configuration of stem sections can be used to provide similar functional benefits as those associated with the embodiments disclosed herein.

The terms "manual" and "manipulation", refers generally to external interaction with certain embodiments or the component parts thereof. Steps or directions that specify manual handling or manipulation describe one application of an external force by, for example, a human hand, but that force can be provided alternatively or additionally by a tool, automated machine or otherwise.

The term "automatic" describes actions and steps which occur without a generally concurrent input of a commensurate mechanical force provided by manual handling or manipulation. A motion, development, change or occurrence shall be deemed automatic when it proceeds without a generally concurrent input of manual handling or manipulation, the force thereof commensurate in magnitude with the force required to perform the motion, development, change or occurrence. A motion, development, change or occurrence is not automatic if the energy used for the performance thereof is, in full or in large part, provided by concurrent manual handling or manipulation. But manual handling or manipulation can provoke or trigger the actuation of an automatic motion, development, change or occurrence. For example, a motion, development, change or occurrence is automatic if the energy used for the performance thereof is, in full or in large part, drawn from an internal source, such as a battery or resilient spring, which are capable of storing the energy required to produce the desired motion, development, change or occurrence for a substantial time.

Terminology such as, "place," "placement," "immersion" and "partial immersion," used in connection with terminology such as, "container," "vase," "water," "liquid" and "select liquid" refers a use of the embodiments in a manner resembling the handling that is customarily given a natural cut flower, such as the placement of an embodiment of the invention into a container of a select liquid to immerse at least the lower portion thereof. In certain uses, an embodiment is placed into an empty container into which a select liquid is subsequently added. In alternative embodiments, actuation is accomplished by other techniques for exposing the impeding agent or impellent to the select liquid. Such alternatives include, but are not limited to the use of vapor, fog, a spray, sprinkle, shower, flow, stream or partial or full submersion, such as by vase, cup, faucet, sink, hose, rainfall, river, lake, irrigation, water pistol, bowl, pitcher, washing machine, bathtub, swimming pool, or the like.

Conclusion

While the foregoing detailed description discloses several embodiments of the present invention, it should be understood that this disclosure is illustrative only and is not limiting of the present invention. It should be appreciated that the specific configurations and operations disclosed can differ from those described above, and that the methods described herein can be used in contexts other than artificial flowers.

Although these inventions have been disclosed in the context of a certain preferred embodiments and examples, it will be understood by those skilled in the art that the present inventions extend beyond the specifically disclosed embodiments to other alternative embodiments and/or uses of the inventions and obvious modifications and equivalents thereof. In addition, while a number of variations of the inventions have been shown and described in detail, other modifications, which are within the scope of the inventions, will be readily apparent to those of skill in the art based upon this disclosure. It is also contemplated that various combinations or subcombinations of the specific features and aspects of the embodiments may be made and still fall within one or more of the inventions. For example, steps of the method(s) disclosed herein can be performed in an order other than that disclosed in the illustrated embodiments, and additional, fewer, or different steps may be performed and still fall within the scope of the inventions. Accordingly, it should be understood that various features and aspects of the disclosed embodiments can be combined with or substituted for one another in order to form varying modes of the disclosed inventions. Thus, it is intended that the scope of the present inventions herein disclosed should not be limited by the particular disclosed embodiments described above.

What is claimed is:

1. An animated artificial flower device, comprising:

a stem;

a piston movably disposed within a piston chamber in the stem, the piston biased by a spring, the piston chamber configured to receive an impeding agent therein; and a plurality of simulated petals defining a corolla, the petals moveable between a closed state and an opened state, the petals operatively coupled to the piston, wherein the piston is configured to move upon an exposure of the impeding agent to a liquid that diminishes the effective size of the impeding agent, the movement of the piston actuating the movement of the petals toward the opened state, the movement of the petals occurring at a rate commensurate to the reduction in the effective size of the impeding agent.

2. The device of claim 1, further comprising a grooved cam operatively coupled to the piston, whereby an oscillatory vibration is imparted to the petals as the piston is moved.

3. The device of claim 1, further comprising a sleeve operatively coupled to the piston, wherein the sleeve is movable relative to the stem so as to align corresponding apertures in the sleeve and the stem, thereby allowing the insertion of the impeding agent into the piston chamber.

4. The device of claim 1, further comprising a sleeve slidably disposed in relation to the stem, wherein a downward movement of the sleeve relative to the stem lifts the artificial flower device, thereby simulating flower growth.

5. The device of claim 1, further comprising a presentation platform, the presentation platform comprising a shaft movably coupled to the stem, the presentation platform configured to move upwardly relative to the stem upon exposure of the impeding agent to a liquid.

6. The device of claim 5, further comprising a sleeve slidably movable in relation to the stem, wherein the presentation platform is configured to move upwardly at a rate that is unequal to the rate of movement of the sleeve.

7. The device of claim 5, further comprising a brake disposed within the stem, the brake being spring loaded and biased toward engagement with the shaft of the presentation platform, wherein the brake is held in a disengaged position by the piston at one position of the piston relative to the brake and configured to engage the shaft to inhibit movement of the presentation platform upon a change in said position of the piston relative to the brake.

8. The device of claim 1, wherein the configurations of the couplings to the piston of at least two of the plurality of petals differ, whereby the petals open with a variation in starting time.

9. The device of claim 1, wherein the corolla is configured to conceal a surprise object when the petals are in the closed state, and to reveal the surprise object when the petals are moved toward the opened state.

10. The device of claim 4, wherein the corolla is configured to rotate about an axis of the stem as the sleeve moves downwardly.

11. The device of claim 1, wherein the impeding agent comprises a dissolvable material, and the liquid comprises a solvent thereof.

12. An animated artificial flower device, comprising:

a stem;

a plurality of simulated petals defining a corolla, the petals moveable between a closed state and an opened state; and apertures in the stem through which a liquid can enter the stem, wherein upon an at least partial immersion of the stem in a liquid, the petals are actuated to move from a starting closed state toward an ending opened state at a gradual and controlled rate.

13. The device of claim 12, further comprising a piston movably disposed within a piston chamber in the stem, the piston biased by a spring, the piston chamber configured to receive an impeding agent therein, whereby upon an exposure of the stem to a liquid, the effective size of the impeding agent is reduced, thereby moving the piston, which actuates the movement of the petals toward the opened state at a rate commensurate to the reduction in the effective size of the impeding agent.

14. The device of claim 12, further comprising a sleeve slidably disposed in relation to the stem, wherein a downward movement of the sleeve relative to the stem lifts the artificial flower device, thereby simulating flower growth.

15. A method for animating an artificial flower having a stem and a plurality of simulated petals operably coupled to the stem, the petals movable between a closed state and an opened state, comprising:

exposing an impeding agent in the stem to a liquid thereby reducing the effective size of the impeding agent; and moving the petals toward the opened state at a rate commensurate to the reduction in the effective size of the impeding agent.

16. The method of claim 15, further comprising upwardly extending a presentation platform.

17. The method of claim 15, further comprising imparting an oscillatory vibration to the petals.

18. The method of claim 15, further comprising moving a sleeve downwardly relative to the stem, thereby simulating flower growth.

19. The method of claim 15, wherein reducing the effective size of the impeding agent comprises dissolving a dissolvable material.

20. The device of claim 12, further comprising a presentation platform, the presentation platform comprising a shaft movably coupled to the stem, the presentation platform configured to move upwardly relative to the stem at a gradual and controlled rate upon an exposure of the stem to a liquid.

21. The device of claim 12, wherein the corolla is configured to conceal a surprise object when the petals are in the closed state, and to reveal the surprise object when the petals are moved towards the opened state.

* * * * *